US009961989B2

(12) United States Patent
Witt

(10) Patent No.: US 9,961,989 B2
(45) Date of Patent: May 8, 2018

(54) RADIAL SCISSOR LIFT TABLE AND METHOD

(71) Applicant: Marc Stefan Witt, Emeryville, CA (US)

(72) Inventor: Marc Stefan Witt, Emeryville, CA (US)

( * ) Notice: Subject to any disclaimer, the term of this patent is extended or adjusted under 35 U.S.C. 154(b) by 0 days. days.

(21) Appl. No.: 15/731,746

(22) Filed: Jul. 27, 2017

(65) Prior Publication Data

US 2017/0367476 A1 Dec. 28, 2017

Related U.S. Application Data

(63) Continuation-in-part of application No. 14/998,932, filed on Mar. 7, 2016.

(51) Int. Cl.

| | |
|---|---|
| ***A47B 9/16*** | (2006.01) |
| ***B66F 7/06*** | (2006.01) |
| ***A47B 13/02*** | (2006.01) |
| ***A47B 13/00*** | (2006.01) |

(52) U.S. Cl.

CPC ..... *A47B 9/16* (2013.01); *A47B 13/003* (2013.01); *A47B 13/02* (2013.01); *B66F 7/0658* (2013.01); *A47B 2013/026* (2013.01)

(58) Field of Classification Search

CPC .. A47B 9/16; A47B 9/04; B60N 2/508; B66F 7/065; B66F 7/066; B66F 7/0658

USPC ..... 108/145, 147; 248/241; 187/269; 254/122, 124

See application file for complete search history.

(56) References Cited

U.S. PATENT DOCUMENTS

| | | | | |
|---|---|---|---|---|
| 730,451 | A | 6/1903 | Friend | |
| 1,709,746 | A | 4/1929 | Schwerin | |
| 1,714,464 | A * | 5/1929 | Merriman | B60S 9/04 254/122 |
| 1,859,830 | A | 5/1932 | Kummel | |
| 2,468,230 | A | 4/1949 | Pollard | |
| 2,582,791 | A * | 1/1952 | Page | A47B 9/16 108/138 |

(Continued)

FOREIGN PATENT DOCUMENTS

| | | |
|---|---|---|
| DE | 102 28 168 A1 | 1/2004 |
| EP | 0 344 196 B1 | 6/1989 |

(Continued)

*Primary Examiner* — Jose V Chen
(74) *Attorney, Agent, or Firm* — John W. Carpenter

(57) ABSTRACT

A radial-scissor lift assembly for a table top comprising an upper support member, a lower support member, and at least three scissor assemblies coupled to the upper and lower support members. Each scissor assembly includes a table-scissor member rotatably supporting a table wheel adapted for contacting an unattached table. Each scissor assembly further includes a floor-scissor member rotatably supporting a floor wheel adapted for contacting a surface supporting the radial-scissor lift assembly. The radial-scissor lift assembly has an actuator assembly coupled to the lower support member and to the upper support member for moving the scissor assemblies. A method for lowering a table top comprising disposing a table top on at least three table rollers, and rolling the table rollers along the bottom on the table top and away from the center of the table top to cause the table top to be lowered.

20 Claims, 22 Drawing Sheets

(56) References Cited

U.S. PATENT DOCUMENTS

| | | | | |
|---|---|---|---|---|
| 3,034,765 | A * | 5/1962 | Ludowici | B66F 3/22 182/69.5 |
| 3,259,369 | A | 7/1966 | Gridley | |
| 3,447,635 | A | 6/1969 | Carlbom | |
| 3,572,758 | A | 3/1971 | Lee | |
| 3,623,707 | A | 11/1971 | Klopp | |
| 3,685,798 | A | 8/1972 | Zoller | |
| 4,405,116 | A | 9/1983 | Eisenberg | |
| 4,460,294 | A | 7/1984 | Cobb | |
| 4,504,041 | A | 3/1985 | Raz | |
| 4,577,821 | A | 3/1986 | Edmo et al. | |
| 4,607,578 | A | 8/1986 | Inoue | |
| 5,722,331 | A | 3/1998 | Machael | |
| 5,950,977 | A | 9/1999 | Proksch | |
| 6,601,826 | B1 | 8/2003 | Granata | |
| 6,679,479 | B1 | 1/2004 | Watkins | |
| 6,742,768 | B2 * | 6/2004 | Alba | A47B 9/16 187/211 |
| 7,213,686 | B2 | 5/2007 | Kaufman | |
| 7,275,332 | B2 * | 10/2007 | Blanding | F16C 11/12 248/178.1 |
| 8,074,369 | B2 | 12/2011 | McMurtry | |
| 8,602,392 | B2 * | 12/2013 | Arghami Nia | B66F 3/12 254/122 |
| 8,733,508 | B2 | 5/2014 | Bacon | |
| 8,827,246 | B2 | 9/2014 | Swasey | |
| 9,440,559 | B2 | 9/2016 | Gundall | |
| 2008/0047068 | A1 * | 2/2008 | Zakrzewski | A61B 6/0457 5/611 |

FOREIGN PATENT DOCUMENTS

| | | | |
|---|---|---|---|
| EP | 1 661 490 | A1 | 5/2006 |
| EP | 1726560 | B1 | 11/2006 |
| FR | 2188421 | A5 | 1/1974 |
| FR | 2816490 | A1 | 5/2002 |
| GB | 326362 | | 3/1930 |
| JP | 2004290644 | A | 10/2004 |
| WO | WO 01/72171 | A1 | 10/2001 |

* cited by examiner

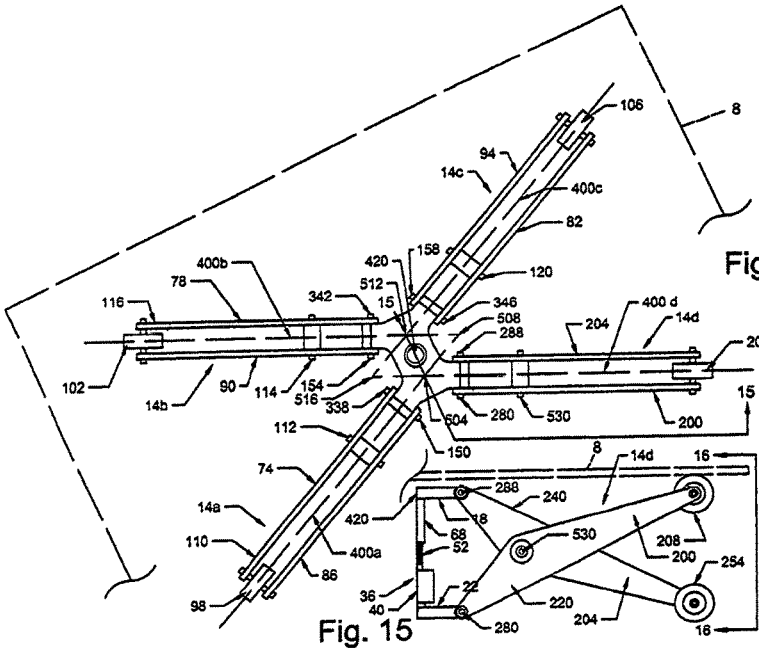
Fig. 14
Fig. 15
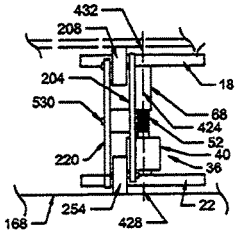
Fig. 16
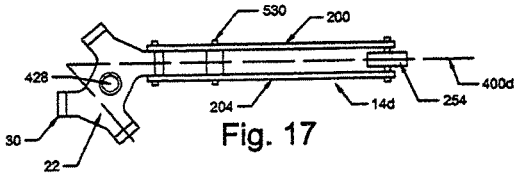
Fig. 17

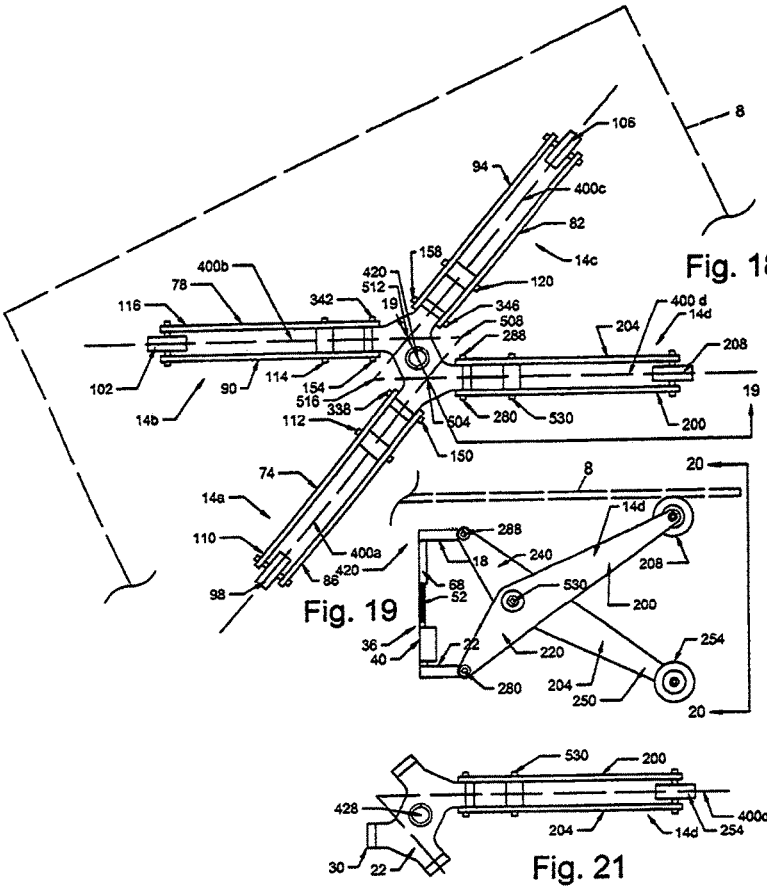
Fig. 18
Fig. 19
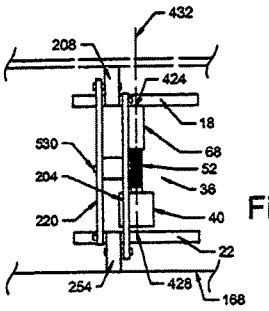
Fig. 20
Fig. 21

RADIAL SCISSOR LIFT TABLE AND METHOD

This is a continuation-in-part patent application of co-pending patent application having application Ser. No. 14/998,932, filed Mar. 7, 2016. Benefit of the Mar. 7, 2016 filing date is claimed.

BACKGROUND OF THE INVENTION

1. Field of Invention

The present invention broadly relates in general to a table and method. More specifically, embodiments of the present invention provide a radial-scissor lift table having a movable top. More specifically further, embodiments of the present invention relate to a method for moving an unattached table top with scissor lift assemblies that are coupled to an actuator assembly which provides the requisite dynamic forces for elevating and lowering the unattached table top relative to a surface that supports the scissor lift assemblies, such as a floor.

2. Description of the Background Art

A table with movable or adjustable height table top employs a mechanism to raise or lower the table top, which is ideal for compact homes, office work stations, dining and leisure activities in accordance with a modern lifestyle. An adjustable height table offers solutions in today's smaller homes, and relaxed office environments. Table height adjustment is ideal for creating a comfortable working height for a variety of work projects, human body dimensions, medical handicaps, chair heights, sofa dimension, and personal comfort preferences for the users.

A mechanism capable of adjusting from a low Coffee Table height of 14 inches, to a conventional Dining Table height of 29 inches, is required to cover the full range of positions desired by the user. In order to elevate a movable table top to these heights, the lift assembly would be required to more than double its initial height. This is difficult to accomplish with a telescoping design, because telescopes have inherent limits of motion. A single telescope mechanism is unable to double its initial length. Multiple telescopes would be necessary to provide motion from 14" to 29". This would create a design having numerous overlapping components for both the frame of the machine, and the actuator. Alternatively, a scissor lift mechanism is capable of adjusting beyond this range of motion. Conventional industrial scissor lifting mechanisms are available, but require complicated coupling brackets to confine the travelling table-top surface to a coaxial position with a vertical axis. Drill holes in the table surface, to mount tracks, links or brackets to the surface are undesirable, especially if the table is made of glass or stone. Furthermore, fasteners that penetrate the table top, damage the top working surface, and reduce the usefulness of the table Thus, what is needed, and what has been invented, is a table having an unattached top, not requiring multiple tracks, fasteners, or any other centering devices, to lock the table top to the frame of the lifting assembly. What is further needed and what has been invented is a stable and dependable method for lowering and elevating table tops.

SUMMARY OF EMBODIMENTS OF THE INVENTION

Embodiments of the present invention provide a scissor lift assembly for raising and lowering an unattached table top. The scissor lift assembly has at least (3) scissor mechanisms mounted in a polar array. The assembly has lower and upper support members; each having at least three radially disposed protruding lugs. The scissor lift assembly also has at least three scissor assemblies coupled to the upper and lower support members in a polar array. Each scissor assembly comprises a table-scissor member having a lower end pivotally connected to one of the lugs of the lower support member and an upper end which supports a rotatable table wheel. Each scissor assembly further comprises a floor-scissor member pivotally connected to the table scissor member and having an upper end pivotally connected to one of the lugs of the upper support member and a lower end which supports a rotatable floor wheel. An actuator assembly is coupled to the lower and upper support members for moving the scissor assemblies. The rotatable table wheels of the table-scissor members support an unattached table top.

Embodiments of the present invention provide further a method for raising a table top. A table top is disposed on at least three table rollers which are coupled to a support member. The table top remains unattached to the table rollers. When the support member is moved towards the unattached table, the table rollers roll along the bottom of the unattached table and raise the table top.

Embodiments of the present invention further provide an offset radial-scissor lift assembly for a table top comprising an upper support member having an upper vertical axis, a lower support member having a lower vertical axis, and a table top having a bottom. A plurality of scissor assemblies couple to the upper and lower support members. The offset radial-scissor lift assembly further comprises an actuator assembly having an actuator axis aligned with the lower vertical axis and the upper vertical axis and coupled to the lower support member and to the upper support member for moving the scissor assemblies. Each of at least two contiguous scissor assemblies of the scissor assemblies have a radial scissor axis which cross at a point offset from the point of the aligned actuator axis, lower vertical axis and upper vertical axis. Each scissor assembly includes a table-scissor member rotatably supporting a table wheel which contacts the bottom of the table top for supporting the table top and for moving on the bottom of the table top towards or away from the upper support member. Each scissor assembly further includes a floor-scissor member rotatably supporting a floor wheel which contacts a surface supporting the offset radial-scissor lift assembly and is adapted for moving on the surface towards or away from the lower support member.

Embodiments of the present invention yet further also provide a radially-centered scissor lift assembly for a table top comprising an upper support member having an upper vertical axis, a lower support member having a lower vertical axis, and a table top having a bottom. A plurality of scissor assemblies are coupled to the upper and lower support members. The radially-centered scissor lift assembly further comprises an actuator assembly having an actuator axis aligned with the lower vertical axis and the upper vertical axis and coupled to the lower support member and to the upper support member for moving the scissor assemblies. Each of the scissor assemblies have a radial scissor axis which all cross at a point with the aligned actuator axis, lower vertical axis and upper vertical axis. Each scissor assembly includes a table-scissor member rotatably supporting a table wheel which contacts the bottom of the table top for supporting the table top and for moving on the bottom of the table top towards or away from the upper support member. Each scissor assembly further includes a floor-scissor member rotatably supporting a floor wheel which contacts a surface supporting the scissor lift assembly and is adapted for moving on the surface towards or away from the lower support member.

These provisions, together with the various ancillary provisions and features which will become apparent to those skilled in the art as the following description proceeds, are attained by the apparatuses and methods of the present invention, preferred embodiments thereof being shown with reference to the accompanying drawings, by way of example only, wherein:

BRIEF DESCRIPTION OF THE DRAWINGS

FIG. 14 is a top plan view of another embodiment of the invention wherein an offset radial-scissor lift assembly for a table is shown in the low position and where each of at least two contiguous scissor assemblies of the 4 scissor assemblies have a radial scissor axis which cross at a point offset from the point where the actuator axis of the actuator assembly, the lower vertical axis of the lower support member and the upper vertical axis of the upper support member are all aligned.

FIG. 15 is a side elevational view taken in direction of the arrows and along the plane of line 15-15 in FIG. 14.

FIG. 16 is an end elevational view taken in direction of the arrows and along the plane of line 16-16 in FIG. 15.

FIG. 17 is a bottom plan view of the lower support member and one of the scissor assemblies in FIG. 14 coupled thereto.

FIG. 18 is a top plan view of the embodiment of the invention of FIG. 14 wherein the offset radial-scissor lift assembly for a table is shown in the mid-way position and where each of at least two contiguous scissor assemblies of the 4 scissor assemblies have a radial scissor axis which cross at a point offset from the point where the actuator axis of the actuator assembly, the lower vertical axis of the lower support member and the upper vertical axis of the upper support member are all aligned.

FIG. 19 is a side elevational view taken in direction of the arrows and along the plane of line 19-19 in FIG. 18.

FIG. 20 is an end elevational view taken in direction of the arrows and along the plane of line 20-20 in FIG. 19.

FIG. 21 is a bottom plan view of the lower support member and one of the scissor assemblies in FIG. 18 coupled thereto.

DETAILED DESCRIPTION OF EMBODIMENTS OF THE INVENTION

In the description herein for embodiments of the present invention, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Figure 1:
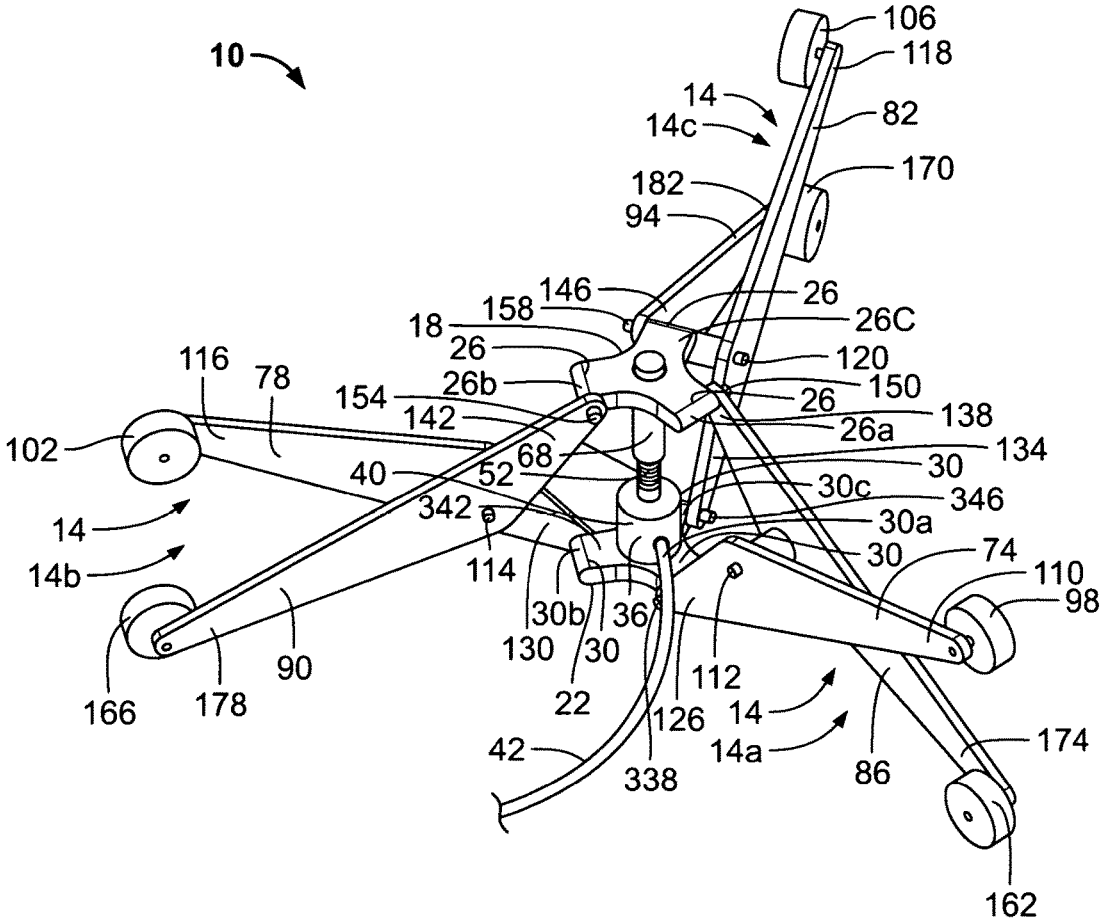
FIG. 1 is a perspective view of an embodiment of the radial-scissor lift assembly for an unattached table top.
Figure 2:
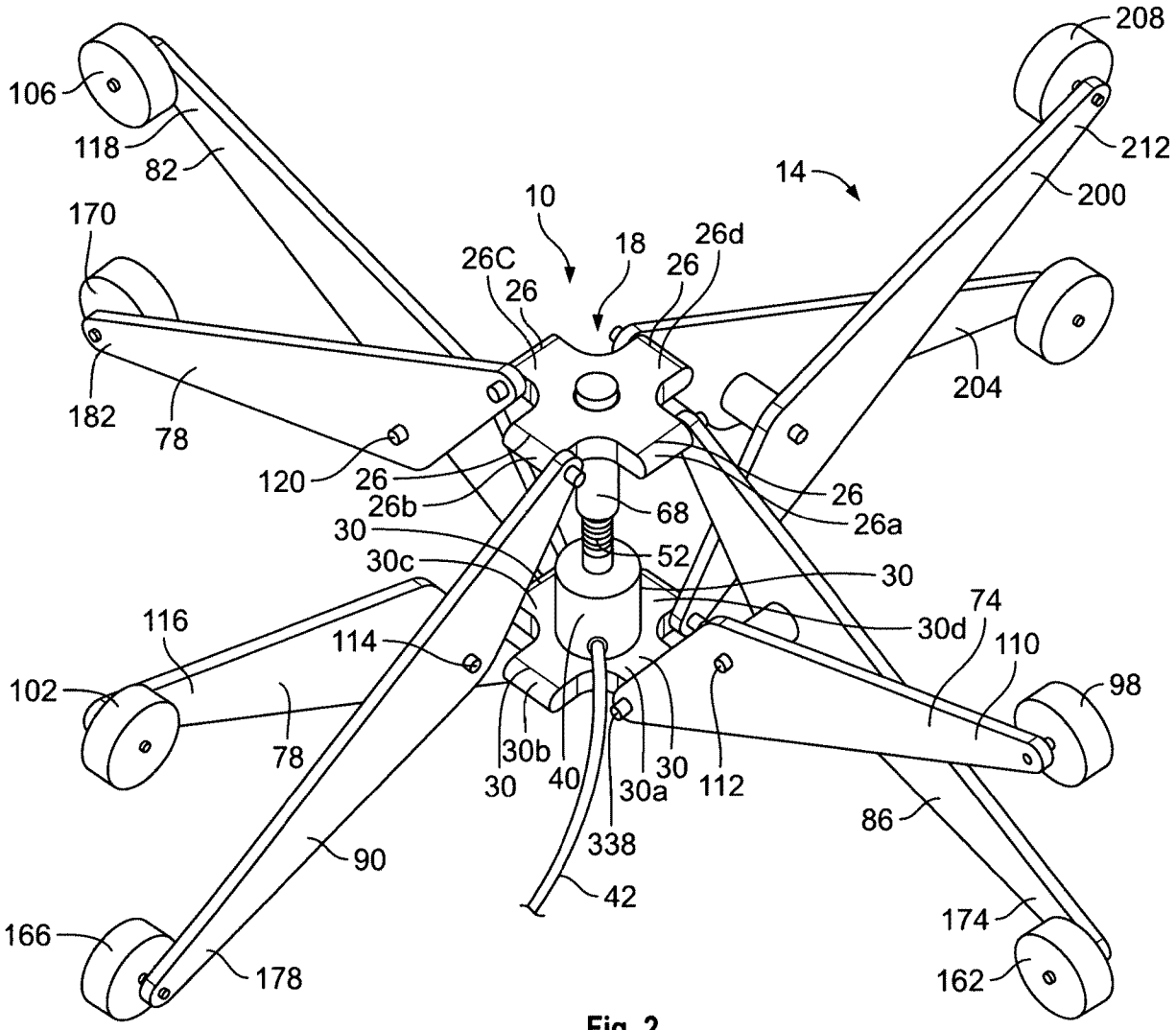
FIG. 2 is a perspective view of another embodiment of the radial-scissor lift assembly for an unattached table top.
Figure 9:
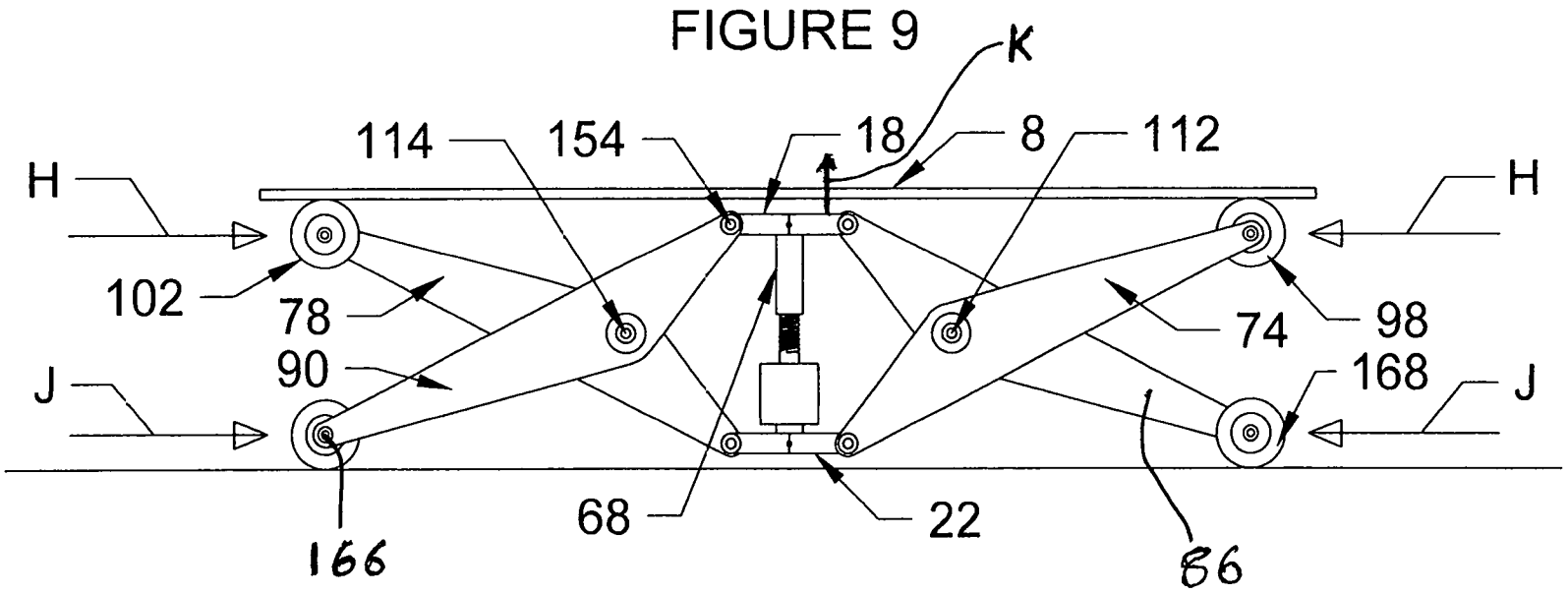
FIG. 9 is a side elevational view of the table assembly of FIG. 8 with horizontal arrows indicating the direction of travel of the rotatable table wheel members and the rotatable floor wheel members, and the vertical arrow indicating the direction of travel for the unattached table top, when the table assembly is to be placed in an elevated position by the actuator assembly.
Figure 10:
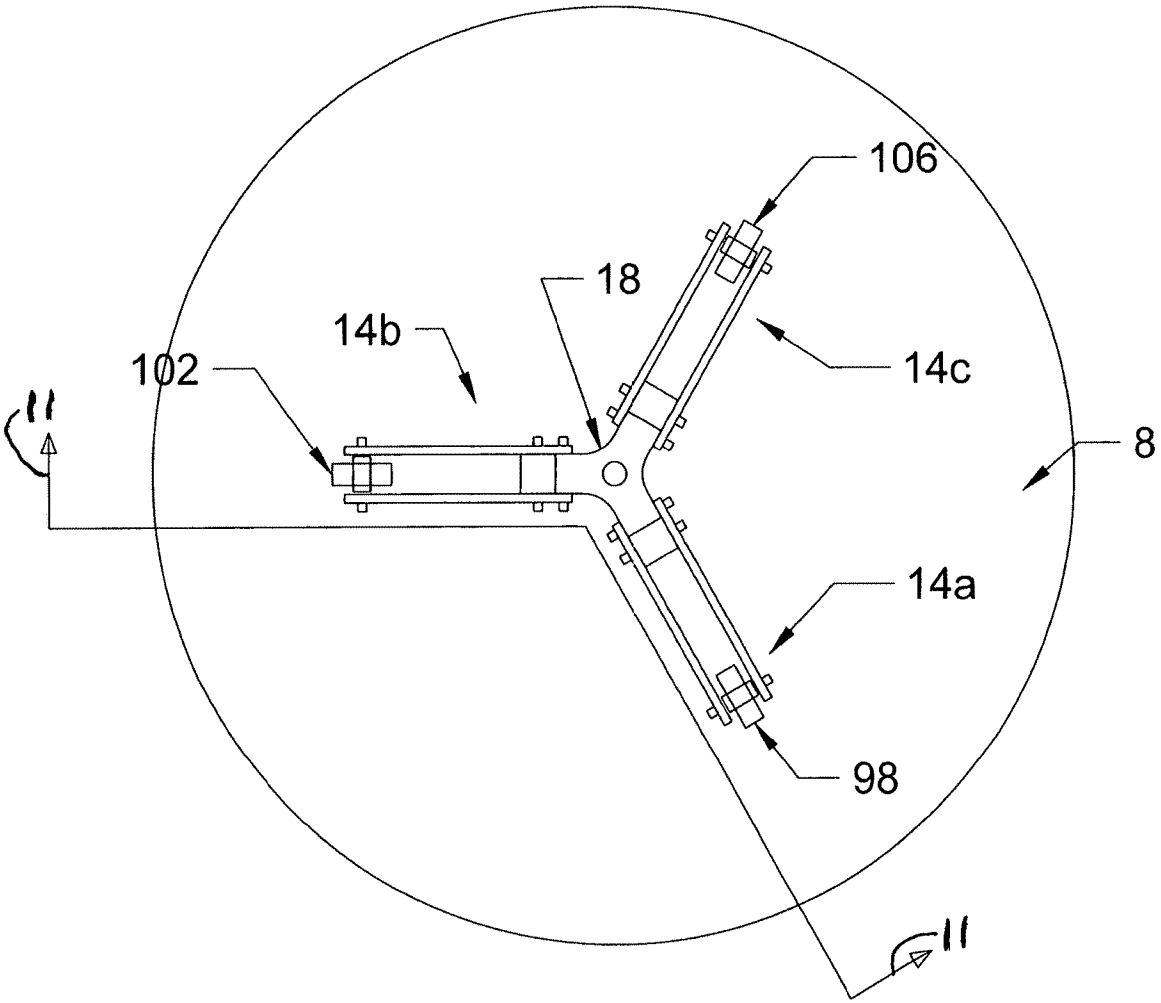
FIG. 10 is a top plan view of an unattached transparent (e.g. glass) table top supported by the radial-scissor lift assembly in an elevated position.
Figure 11:
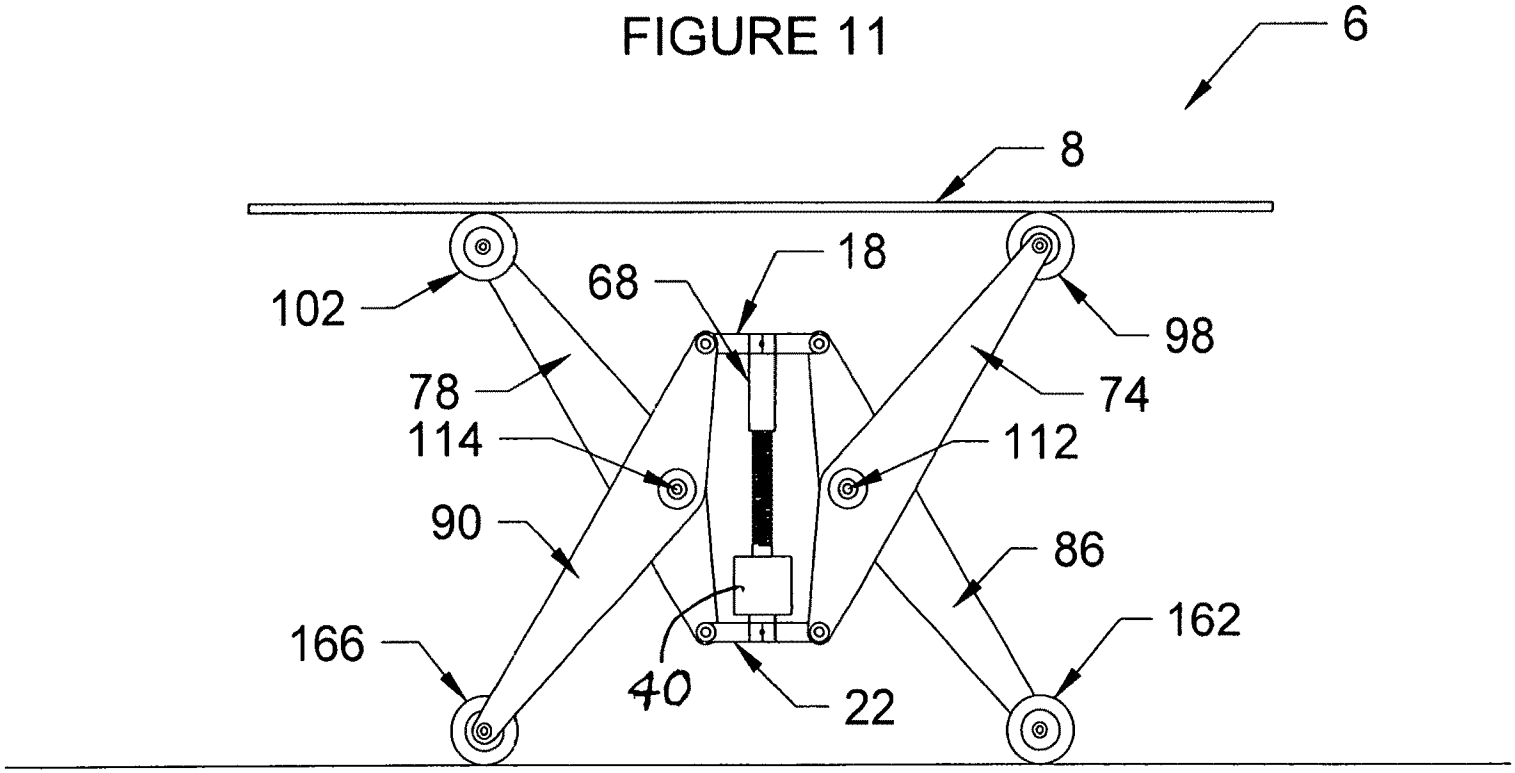
FIG. 11 is a sectional view taken in direction of the arrows 11-11 in FIG. 10 of the radial-scissor lift assembly supporting the unattached transparent table top in an elevated position.

Referring in detail now to the drawings, there is seen in FIGS. 1 and 2 embodiments of a scissor-lift assembly, generally illustrated as 10, for elevating and lowering an unattached table top 8 (see FIGS. 10 and 11). The unattached table top 8 may possess any geometric shape (e.g., square or circular) and may be made of any material (e.g., wood, metal or glass). For purposes of explaining the present invention, the table top 8 is transparent (e.g. glass) and possesses a circular shape. The combination of the scissor-lift assembly 10 and the unattached table top 8 forms a table 6, as shown in FIGS. 9 and 11.

In the embodiments of FIGS. 1 and 2, the scissor-lift assembly 10 respectively has three (3) and four (4) scissor assemblies, each generally illustrated as 14. It is to be understood that the scissor-lift assembly 10 may have any number of scissor assemblies 14. However, preferably at least three (3) scissor assemblies 14 are employed so the table 6 is stable.

The scissor-lift assembly 10 also comprises an upper support member 18 and a lower support member 22. The upper and lower support members 18 and 22 respectively include radially protruding lugs 26 and 30. The number of lugs formed with support members 18 and 22 depend on the number of scissor assemblies 14 to be employed. For the embodiment of the scissor-lift assembly 10 in FIG. 1, because three scissor assemblies 14 (each more specifically identified as 14*a*, 14*b* and 14*c*) are used, upper support member 18 has three lugs 26 (each more specifically identified as lugs 26*a*, 26*b* and 26*c*); and lower support member 22 likewise has three lugs 30, each more specifically identified as lugs 30*a*, 30*b* and 30*c*), As shown in FIG. 1, the scissor assemblies 14*a*, 14*b* and 14*c* are pivotally coupled to the upper and lower support members 18 and 22 in a polar array. The radially extensions and dispositions of the scissor assemblies 14*a*, 14*b* and 14*c* with respect to each other, are equiangular; that is, the angles between scissor assemblies 14*a*, 14*b*, between scissor assemblies 14*b*, 14*c*, and between scissor assemblies 14*c*, 14*a* are essentially equal.

The embodiment of the scissor-lift assembly 10 in FIG. 2 uses four scissor assemblies 14, each more specifically identified as 14*a*, 14*b*, 14*c* and 14*d*. Thus, upper support member 18 is formed with four lugs 26 (each more specifically identified as lugs 26*a*, 26*b*, 26*c* and 26*d*), and lower support member 22 likewise has four lugs 30, each more specifically identified as lugs 30*a*, 30*b*, 30*c* and 30*d*. As shown in FIG. 2, the scissor assemblies 14*a*, 14*b*, 14*c* and 14*d* are pivotally coupled to the upper and lower support members 18 and 22 in a polar array. As seen for the scissor assemblies 14*a*, 14*b* and 14*c* in FIG. 1, the radially extensions and dispositions of the scissor assemblies 14*a*, 14*b*, 14*c* and 14*d* with respect to each other, in FIG. 2 are also equiangular. More specifically, the angles between scissor assemblies 14*a*, 14*b*, between scissor assemblies 14*b*, 14*c*, and between scissor assemblies 14*c*, 14*d*, and between scissor assemblies 14*d*, 14*a* are essentially equal.

The scissor-lift assembly 10 further comprises an actuator assembly, generally illustrated as 36, which is coupled to the upper and lower support members 18 and 22. The actuator assembly 36 for purposes of embodiments of the present invention may be any suitable mechanism or system that is capable of moving (e.g., raising and lowing) or controlling the movement of unattached table top 8.

Typically, actuator assemblies are operated by a control system that transforms circular or rotary motion into linear motion. The transformation may be any suitable converting mechanisms, such as electrical, mechanical (e.g. rack and pinion), hydraulic or pneumatic, or any other type of converting system. Activation of the control system may be by any suitable means, such as by remote control of the type which remotely turns on or off a television or other electronic device.

As known to those possessing ordinary skill in the art, a hydraulic actuator consists of a cylinder or fluid motor that uses hydraulic power to facilitate mechanical operation whose output may be linear, rotary or oscillatory motion. A pneumatic actuator converts energy formed by vacuum or compressed air at high pressure into either linear or rotary motion. Motors are commonly employed when circular or rotary motions are needed for transformation into a linear motion.

For purposes of describing the present invention, the actuator assembly 36 includes a mechanism which generates a linear motion from a circular motion created by a conventional electric motor 40 that receives power through a cord 42 (see FIG. 1). However, the actuator assembly 36 is not to be limited to such an actuator assembly. The spirit and scope of the present invention is to include any type of actuator assembly which is capable of raising or lowering unattached table top 8.

Figure 3:
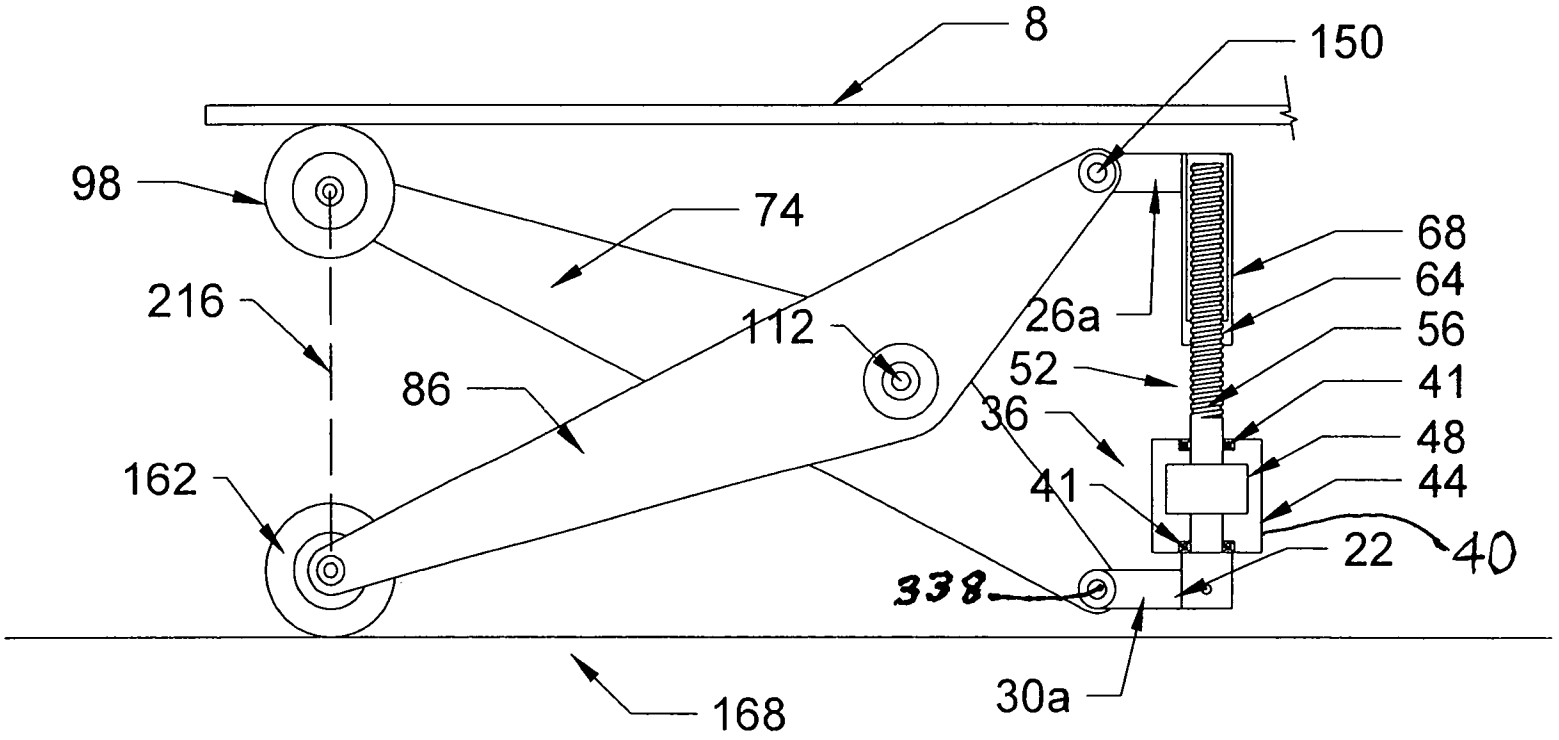
FIG. 3 is a partial vertical sectional view of an embodiment of a radial-scissor lift assembly having an actuator assembly which has positioned an unattached table in a lower position.
Figure 4:
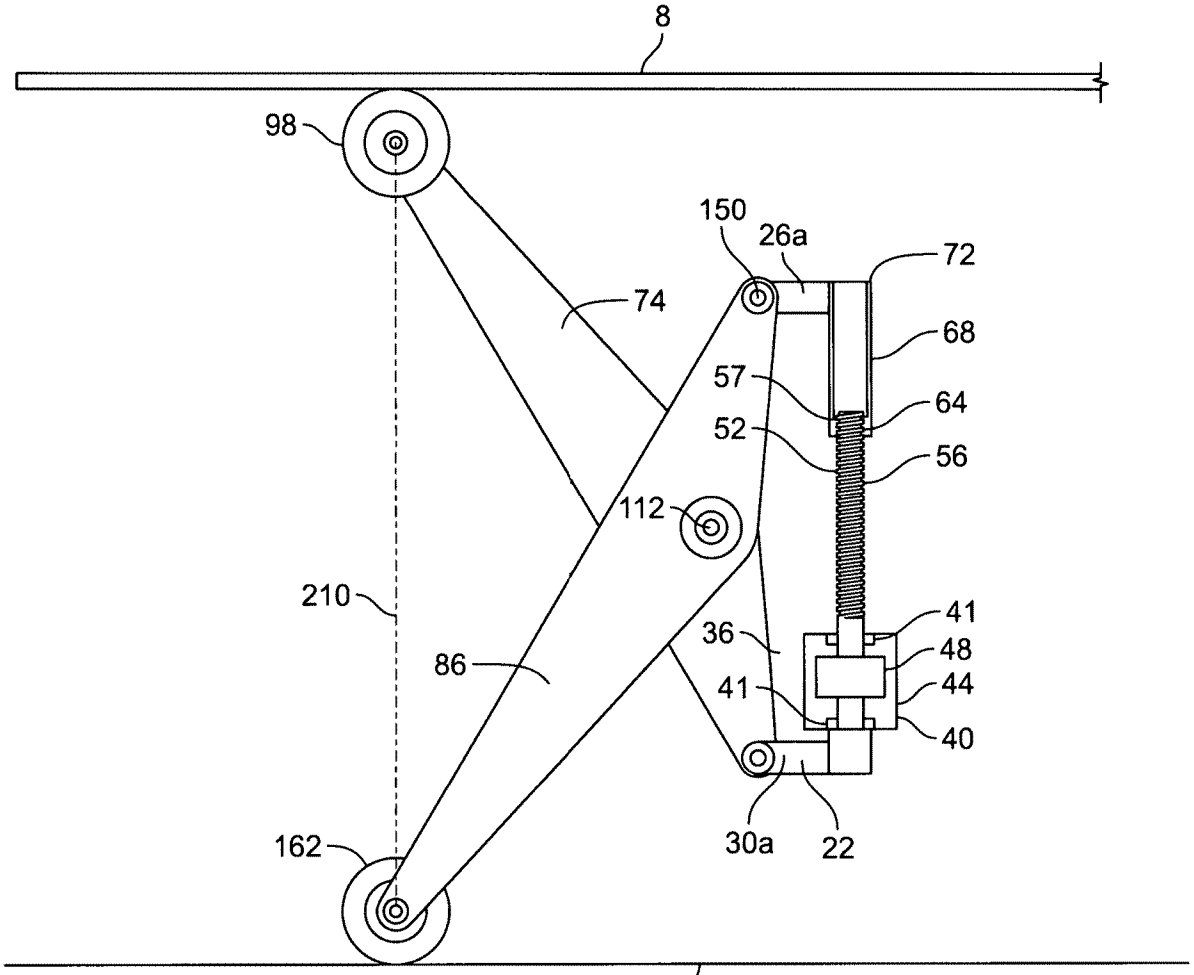
FIG. 4 is a partial vertical sectional view of an embodiment of a radial-scissor lift assembly having an actuator assembly which has positioned an unattached table in an elevated position.

The motor 40 is supported by the lower support member 22 (see FIG. 3 by way of example) and includes a stator 44 and a rotor 48. A threaded shaft 52 is coupled to the motor 40 and rotates when the motor 40 is energized. Bearings 41-41 are conveniently positioned as best shown in FIGS. 3 and 4. The threaded shaft 52 has threads 56 that mesh with threads 60 of a nut member 64 (see FIG. 5) which connects or is bound to terminal end 57 (see FIG. 4) of a conduit 68 which houses the threaded shaft 52 as it linearly moves, Conduit 68 and nut member 64 form a tubular nut assembly.

Conduit 68 also has a terminal end 72 which is stationarly affixed to the upper support member 18 When motor 40 rotates treaded shaft 52 clockwise in direction of arrow D (see FIG. 5), shaft 52 commences to linearly move in direction of the arrow A, causing the conduit 68 to begin linearly accepting the shaft 52 as it linearly travels internally within conduit 68 in direction of the arrow B. As threaded shaft 52 linearly moves in direction of the arrow A, the motor 40 appended to and associated with the shaft 52 linearly moves with the shaft 52, causing the lower support member 22 attached to the motor 40 to follow the motor 40 towards nut member 64.

Simultaneously with clockwise rotation of threaded shaft 52, and the linear movement of the shaft 52 in direction of the arrow B within conduit 68, there is a secondary dynamic force moving conduit 68 in direction of the arrow C (see FIG. 5) and towards motor 40. Any friction or resistance in movement of the motor 40 towards nut member 64 would cause the nut member 64, along with the conduit 68 and upper support member 18 secured to the terminal end 72 of the conduit 68, to travel in direction of the arrow C in FIG. 5. In the event motor 40 and the lower support member 22 coupled to the motor 40, remained stationary, nut member 64 and conduit 68 (and attached upper support member 18) would solely move in direction of arrow C in FIG. 5 as shaft 52 rotates. Typically, motor 40 and lower support member 22, do not remain stationary. Thus, rotating shaft 52 causes a dual dynamic force; one forcing the motor 40 and lower support member 22 to move in direction of the arrow A (see FIG. 5); the other forcing the nut member 64, the conduit 68 connected to the nut member 64, and the upper support member 18 coupled to the conduit 68, to move in direction of the arrow C. Thus, upper and lower support members 18 and 22 movement towards each other caused by the clockwise rotating shaft 52, produces dual dynamic forces. As will be further explained hereafter, rotation of shaft 52 clockwise (in direction of the arrow D) by the motor 40 causes the scissor-lift assembly 10 to be placed in the collapsed or lowered position illustrated in FIGS. 7 and 9, which concomitantly postures the unattached table 8 in a lowered position.

Figure 12:
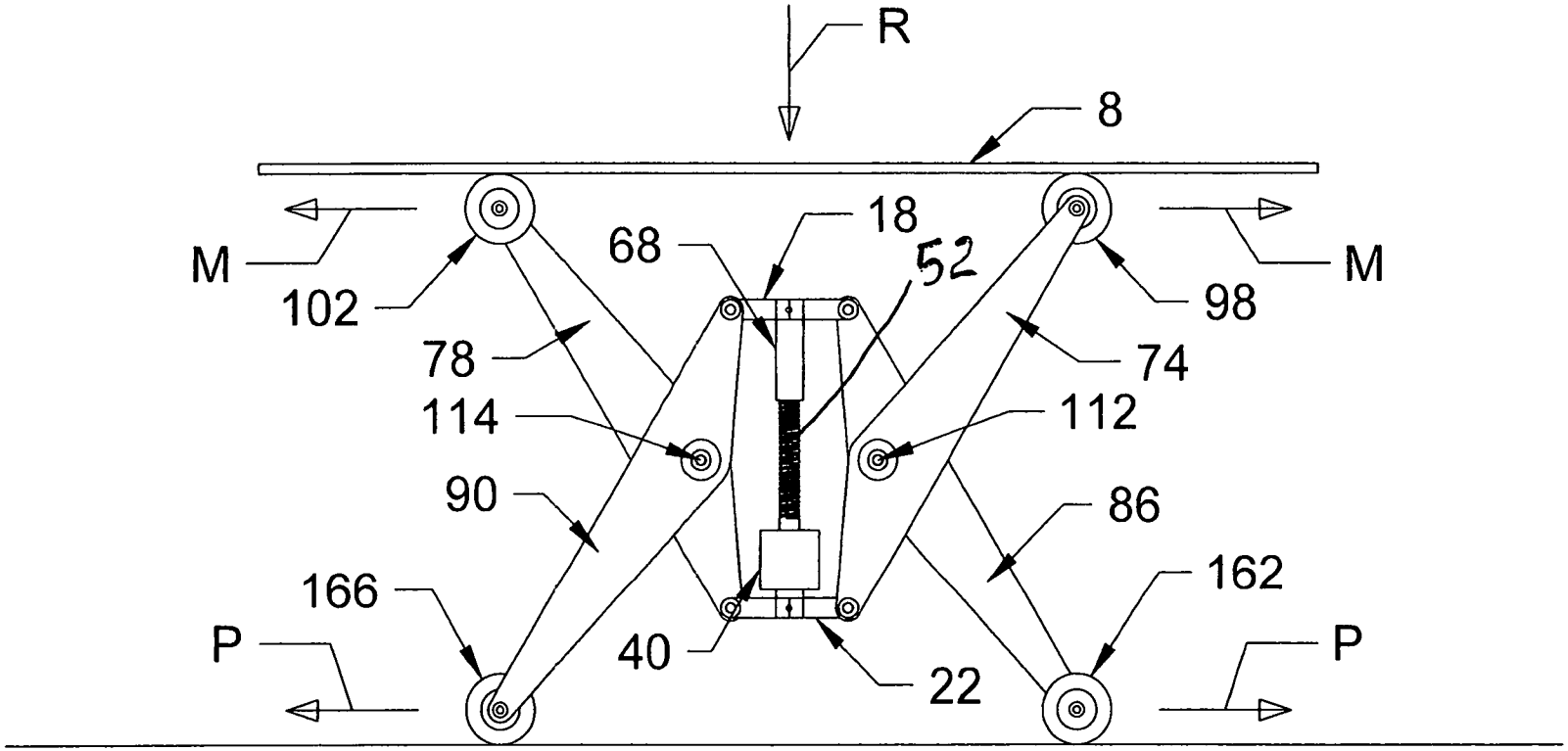
FIG. 12 is a top plan view of an unattached transparent (e.g. glass) table top supported by rotatable table wheels mounted to the table-scissor members of the radial-scissor lift assembly with arrows pointing in the direction of travel for lowering the unattached table top into a lowered position.
Figure 13:
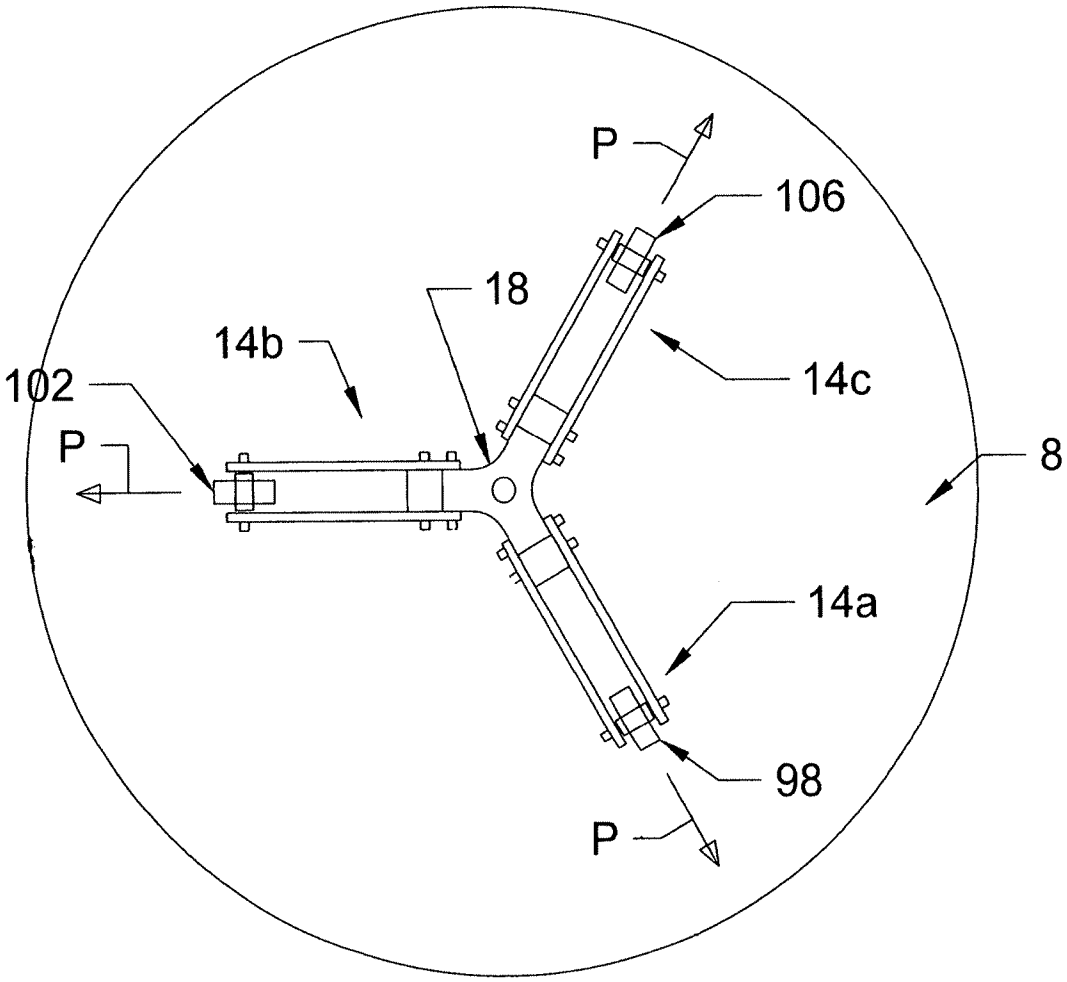
FIG. 13 is a side elevational view of the table assembly of FIG. 12 with horizontal arrows indicating the direction of travel of the rotatable table wheel members and the rotatable floor wheel members, and the vertical arrow indicating the direction of travel for the unattached table top, when the table assembly is to be placed in a lowered position by the actuator assembly.

As will also be further explained hereafter, reversing the entire foregoing procedure would cause the scissor-lift assembly 10 to be positioned in an expanded or elevated state, as illustrated in FIG. 11. More specifically, reversing the procedure entails inter alia causing motor 40 to rotate shaft 52 counter-clockwise (i.e., in direction of arrow E in FIG. 5). This causes shaft 52 to linearly move in direction of the arrow F, and conduit 68 to move oppositely; that is, in direction of arrow G (see FIG. 5 again). Movement of the shaft 52 and conduit 68 accordingly, results in upper and lower support members 18 and 22 moving away from each other, causing the scissor-lift assembly 10 to be eventually disposed in an elevated position, such as that shown in FIGS. 11 and 12. This places unattached table 8 in an elevated or raised position as also shown in FIGS. 11 and 12. It is to be understood that the present invention is not to restrict or limit the placement of unattached table 8 in only two positions, i.e., the positions shown in FIGS. 9 and 11. By controlling the operation of the motor 40, unattached table 8 may be postured in any position between the lowermost shown in FIG. 9 and the uppermost shown in FIG. 11.

Figure 7:
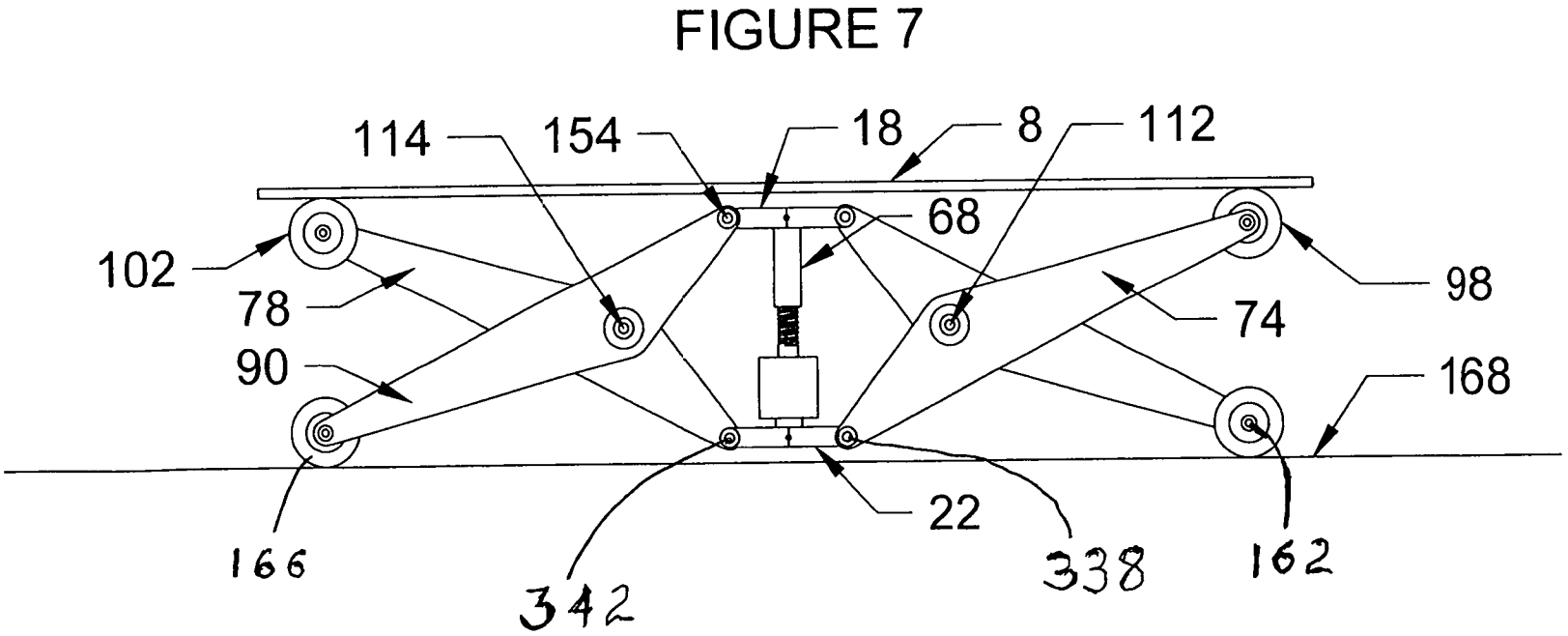
FIG. 7 is a sectional view taken in direction of the arrows 7-7 in FIG. 6 of the radial-scissor lift assembly supporting an unattached transparent table top in a lowered position.
Figure 8:
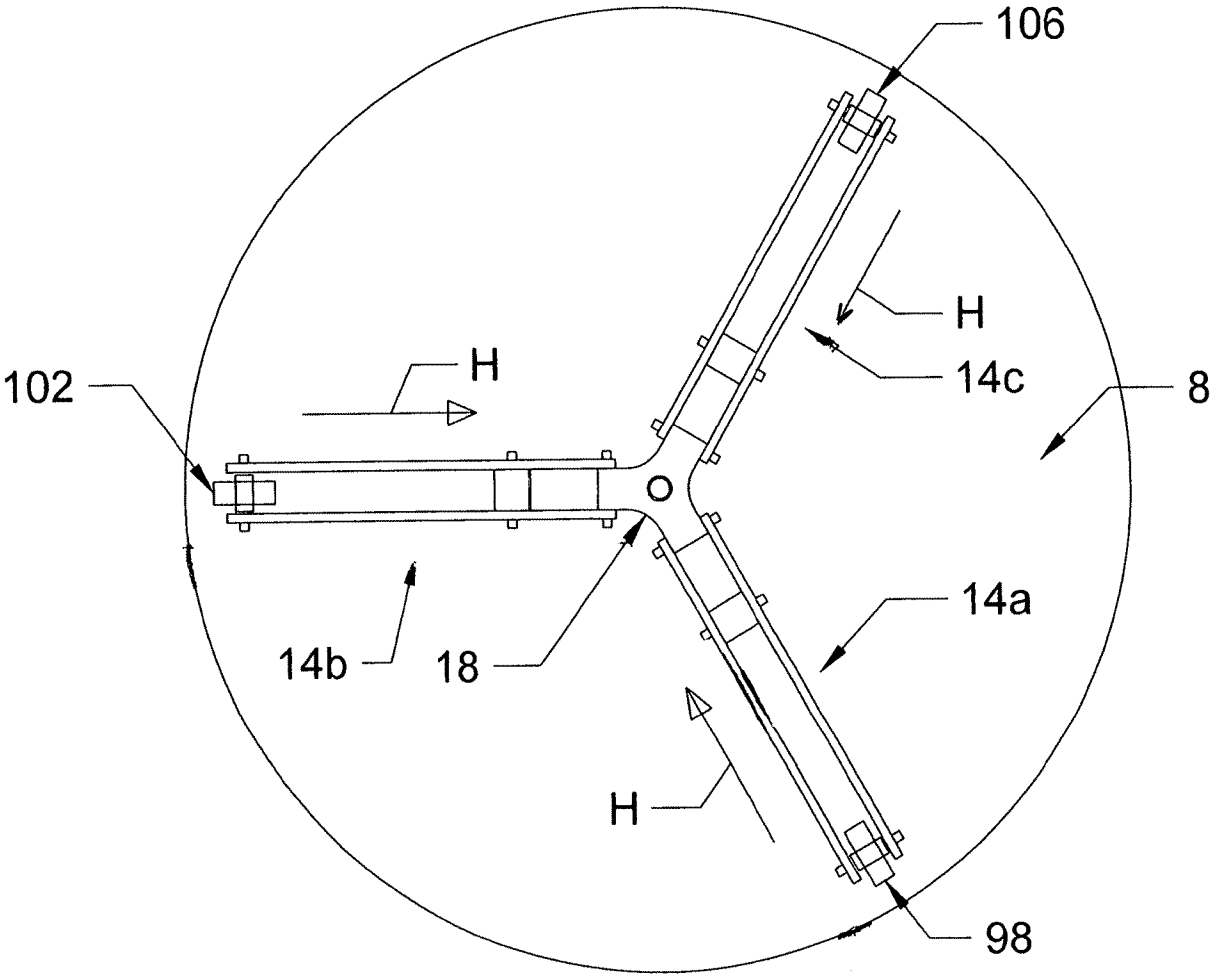
FIG. 8 is a top plan view of an unattached transparent (e.g. glass) table top supported by rotatable table wheels mounted to the table-scissor members of the radial-scissor lift assembly with arrows pointing in the direction of travel for raising the unattached table top into an elevated position.

As shown in FIG. 1, scissor assemblies 14*a*, 14*b*, and 14*c* respectively have table-scissor members 74, 78 and 82, and floor-scissor members 86, 90 and 94. Table-scissor members 74, 78 and 82 rotatably support table wheels 98, 102 and 106 at respective upper extremities 110, 116 and 118. Points 112, 114, and 120 are pivot points for table-scissor members 74, 78 and 82, against floor-scissor members 86, 90 and 94 so when table-scissor members 74, 78 and 82 simultaneously move relative to each other at points 112, 114 and 120, movement is in a scissor-like fashion. As best shown in FIGS. 3, 4 and 7, table wheels 98, 102 and 106 support unattached table top 8.

Lower extremities 126, 130 and 134 of table-scissor members 74, 78 and 82 couple to lugs 30*a*, 30*b* and 30*c* of lower support member 22 at pivot points 338, 342 and 346. Upper extremities 138, 142 and 146 of floor-scissor members 86, 90 and 94 couple to lugs 26*a*, 26*b* and 30*c* at pivot points 150, 154 and 158. As best shown in FIGS. 3, 4 and 7, floor-scissor members 86, 90 and 94 rotatably support floor wheels 162, 166 and 170, at respective lower extremities 174, 178 and 182. Floor wheels 162, 166 and 170 roll on a floor 168 for supporting the table 6.

Referring now to FIG. 2, in addition to the scissor assemblies of 14*a*, 14*b* and 14*c*, there is seen scissor assembly 14*d* having table-scissor member 200 and floor-scissor member 204. Table-scissor member 200 rotatably supports table wheel 208 at upper extremity 212. The pivot point where table-scissor member 200 pivots against floor-scissor member 204 for moving table-scissor member 200 and floor-scissor member 204 relative to each other in a scissor-like fashion is not shown. Table wheel 208 supports unattached table top 8. Lower extremity 220 of table-scissor member 200 couples to lug 30*d* at pivot point 280 and the upper extremity 240 of floor-scissor member 204 couples to lug 26*d* at pivot point 288. The lower extremity 250 of floor-scissor member 204 rotatably supports floor wheel 254 which rolls on the floor 168 for supporting the table 6.

Referring now to the drawings for operation of the scissor lift assembly 10 of the present invention, the three wheel scissor assemblies 14*a*, 14*b* and 14*c* will be employed to explain the operation; however, it is to be understood that the four wheel scissor assemblies 14*a*, 14*b*, 14*c* and 14*d* operate similarly or identically to the three wheel scissor assemblies 14*a*, 14*b* and 14*c* with the exception that the three wheel scissor assemblies 14*a*, 14*b*, and 14*c* excludes the additionally scissor assembly 14*d*.

There is seen in FIGS. 3 and 7 scissor-lift assembly 10 in the lowered position, supporting unattached table 8 on table wheels 98, 102 and 106. In order to elevate the unattached table 8 to the elevated position illustrated in FIG. 11, motor 40 is turned on and then activated, causing treaded shaft 52 to commence rotating counter-clockwise in direction of arrow E (see FIG. 5). As shaft 52 rotates counter-clockwise, it begins to move in the linear direction represented by arrow F in FIG. 5, withdrawing from within conduit 68 and causing motor 40, and the lower support member 22 attached to the motor 40, to travel away from conduit 68 and the upper support member 18 secured to conduit 68. As conduit 68 and the upper support member 18 move away from motor 40 and the lower support member 22, the scissor assemblies 14*a*, 14*b* and 14*c* begin opening, and table wheels 98, 102 and 106 and floor wheels 162, 166 and 170 to respectively move in direction of arrows H and arrows J, and unattached table 8 to move indirection of arrow K (see FIG. 9).

When scissor assemblies 14*a*, 14*b* and 14*c* are opening, table-scissor members 74, 78 and 82 (and their respective associated table wheels 98, 102 and 106) and floor-scissor members 86, 90 and 94 (and their respective associated floor wheels 162, 166 and 170) pivot about pivot points 112, 114 and 120 and are moving away from each other. Simultaneously, lower extremities 126, 130 and 134 of table-scissor members 74, 78 and 82 pivot on lugs 30*a*, 30*b* and 30*c* of lower support member 22 at pivot points 338, 342 and 346; and upper extremities 138, 142 and 146 of floor-scissor member members 86, 90 and 94 pivot on lugs 26*a*, 26*b* and 26*c* at pivot points 150, 154 and 158. In a preferred embodiment of the invention, as the scissor assemblies 14*a*, 14*b* and 14*c* move towards the open position, table rollers 98, 102 and 106 are rolling along the bottom of unattached table 8 towards centrally disposed actuator assembly 36, and unattached table 8 is moving upwardly in direction of the arrow K. In a further preferred embodiment of the invention, as table wheels 98, 102 and 106 move respectively away from floor wheels 162, 166 and 170, the hubs of the wheels remain in generally vertically aligned along the dashed-lined arrows 210 and 216, as best shown in FIG. 3 and FIG. 4. Movements continue until unattached table 8 reaches the elevated position illustrated in FIGS. 11 and 12. Motor 40 then automatically turns off and deactivated, or motor 40 may be manually turned off.

Figure 5:
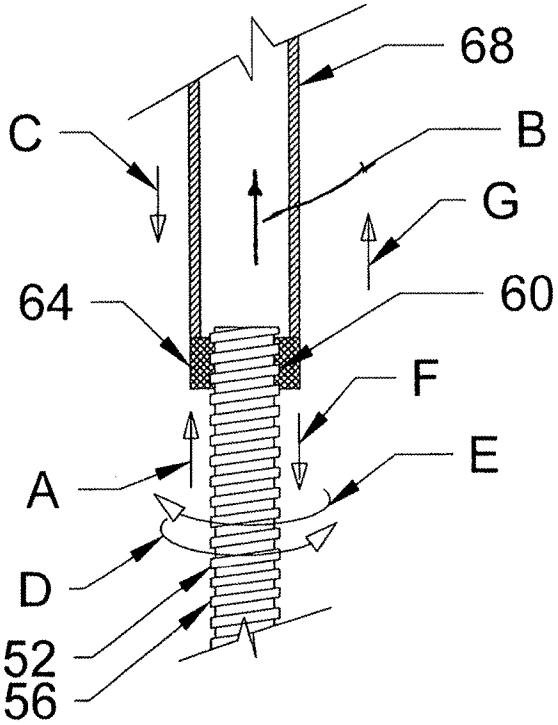
FIG. 5 is a partial vertical sectional view of the tubular nut member threadably engaged to the threaded motor shaft which is rotated by the motor for operating the scissor lift assemblies to raise or lower an unattached table.
Figure 6:
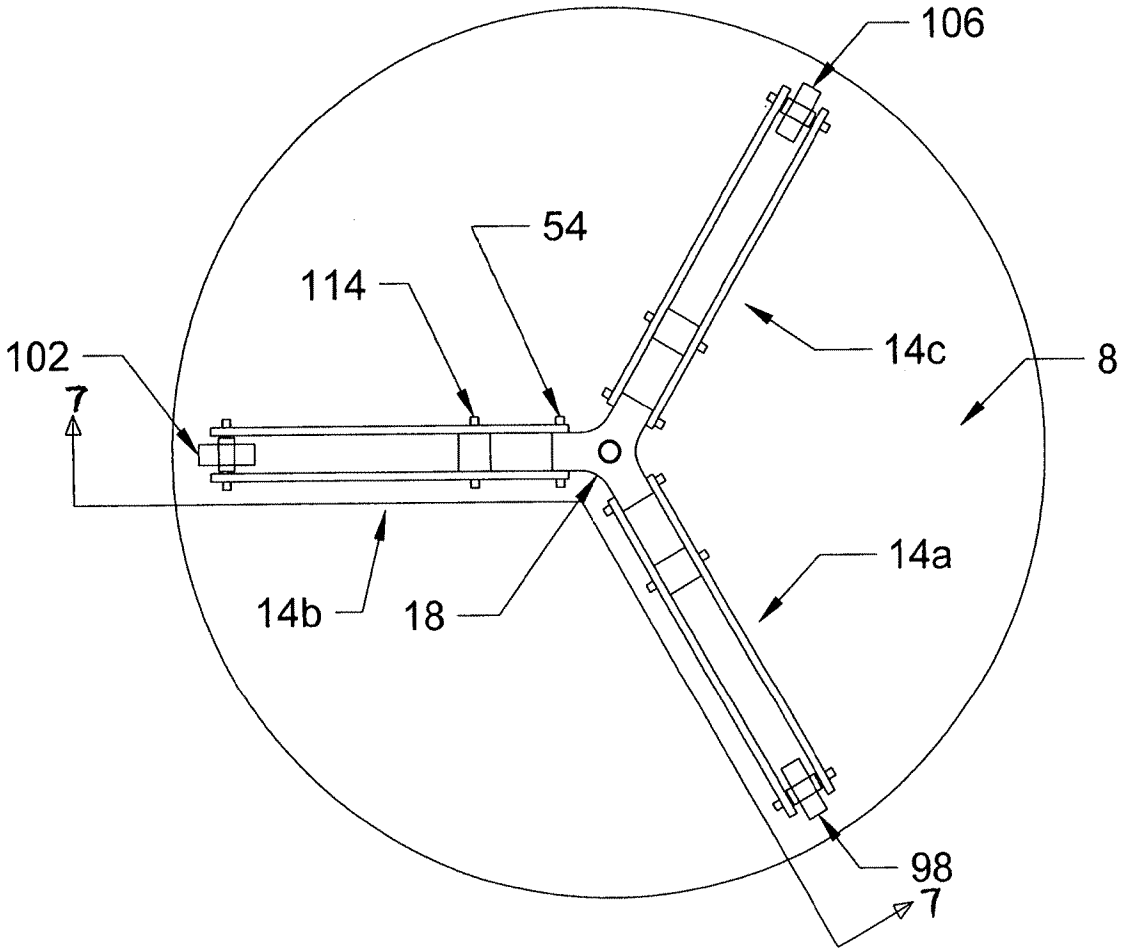
FIG. 6 is a top plan view of an unattached transparent (e.g. glass) table top supported by rotatable table wheels of table-scissor members of the radial-scissor lift assembly.

Continuing to refer to the drawings for reversing the procedure to lower the unattached table 8 from the elevated position illustrated in FIG. 11 to the collapsed or lowered position illustrated in FIG. 7, motor 40 is turned on and then activated to cause treaded shaft 52 to commence rotating clockwise in direction of arrow D (see FIG. 5). As shaft 52 rotates clockwise, it begins to move in the linear direction represented by arrow F in FIG. 5, gradually entering conduit 68 and causing motor 40, and the lower support member 22 attached to the motor 40, to travel towards the lower support member 22 supporting motor 40. As conduit 68 and the upper support member 18 towards motor 40 and the lower support member 22, the scissor assemblies 14*a*, 14*b* and 14*c* begin closing, and table wheels 98, 102 and 106 and floor wheels 162, 166 and 170 to respectively move in direction of arrows M and arrows P, and unattached table to move indirection of arrow R (see FIG. 12).

When scissor assemblies 14*a*, 14*b* and 14*c* are closing, table-scissor members 74, 78 and 82 (and their respective associated table wheels 98, 102 and 106) and floor-scissor members 86, 90 and 94 (and their respective associated floor wheels 162, 166 and 170) pivot about pivot points 112, 114 and 120 and are moving towards from each other. Simultaneously, lower extremities 126, 130 and 134 of table-scissor members 74, 78 and 82 pivot on lugs 30*a*, 30*b* and 30*c* of lower support member 22 at pivot points 338, 342 and 346; and upper extremities 138, 142 and 146 of floor-scissor members 86, 90 and 94 pivot on lugs 26*a*, 26*b* and 30*c* at pivot points 150, 154 and 158. In a preferred embodiment of the invention, as the scissor assemblies 14*a*, 14*b* and 14*c* move towards the closed position, table rollers 98, 102 and 106 are rolling along the bottom of unattached table 8 away from centrally disposed actuator assembly 36, and unattached table 8 is moving downwardly in direction of the arrow R. In a preferred embodiment of the invention, as table wheels 98, 102 and 106 move respectively toward floor wheels 162, 166 and 170, the hubs of the wheels remain in generally vertically aligned along the dashed-lined arrows 210 and 216, as best shown in FIG. 3 and FIG. 4. Movements continue until unattached table 8 reaches the lowered position illustrated in FIGS. 9 and 9. Motor 40 then either automatically (or is manually) turned off.

Referring now to FIGS. 14-25 there is seen another embodiment of the invention having four scissor assemblies 14*a*, 14*b*, 14*c* and 14*d* which are alternatively unequally spaced and offset radially for supporting a table top 8 having a non-circular configuration, such as a square or rectangular table top or an oval shaped table top. As shown in FIGS. 14-25, the lower and upper support members 22 and 18, and the lugs 30 and 26 respectively associated with the lower and upper support members 22 and 18, are all configured such that when they are coupled to the four scissor assemblies 14*a*, 14*b*, 14*c* and 14*d*, the four scissor assemblies 14*a*, 14*b*, 14*c* and 14*d* are alternatively unequally spaced and are offset radially (see FIG. 14).

Figure 22:
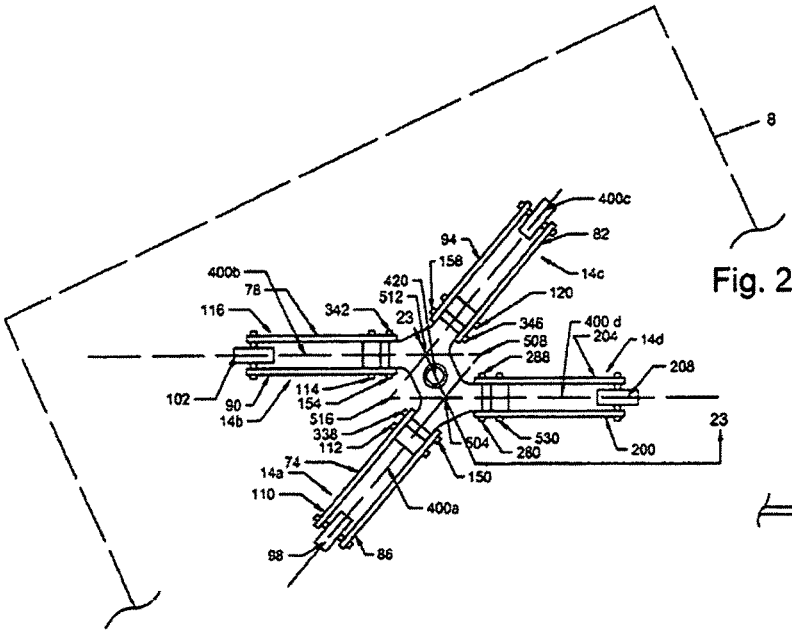
FIG. 22 is a top plan view of the embodiment of the invention of FIG. 14 wherein the offset radial-scissor lift assembly for a table is shown in the high or fully elevated position and where each of at least two contiguous scissor assemblies of the 4 scissor assemblies have a radial scissor axis which cross at a point offset from the point where the actuator axis of the actuator assembly, the lower vertical axis of the lower support member and the upper vertical axis of the upper support member are all aligned.
Figure 24:
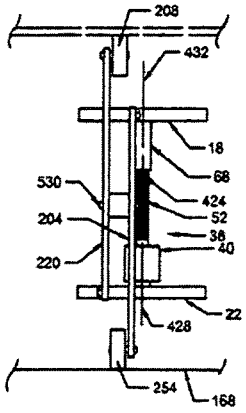
FIG. 24 is an end elevational view taken in direction of the arrows and along the plane of line 24-24 in FIG. 23.
Figure 25:
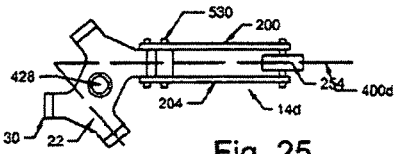
FIG. 25 is a bottom plan view of the lower support member and one of the scissor assemblies in FIG. 22 coupled thereto.
Figure 23:
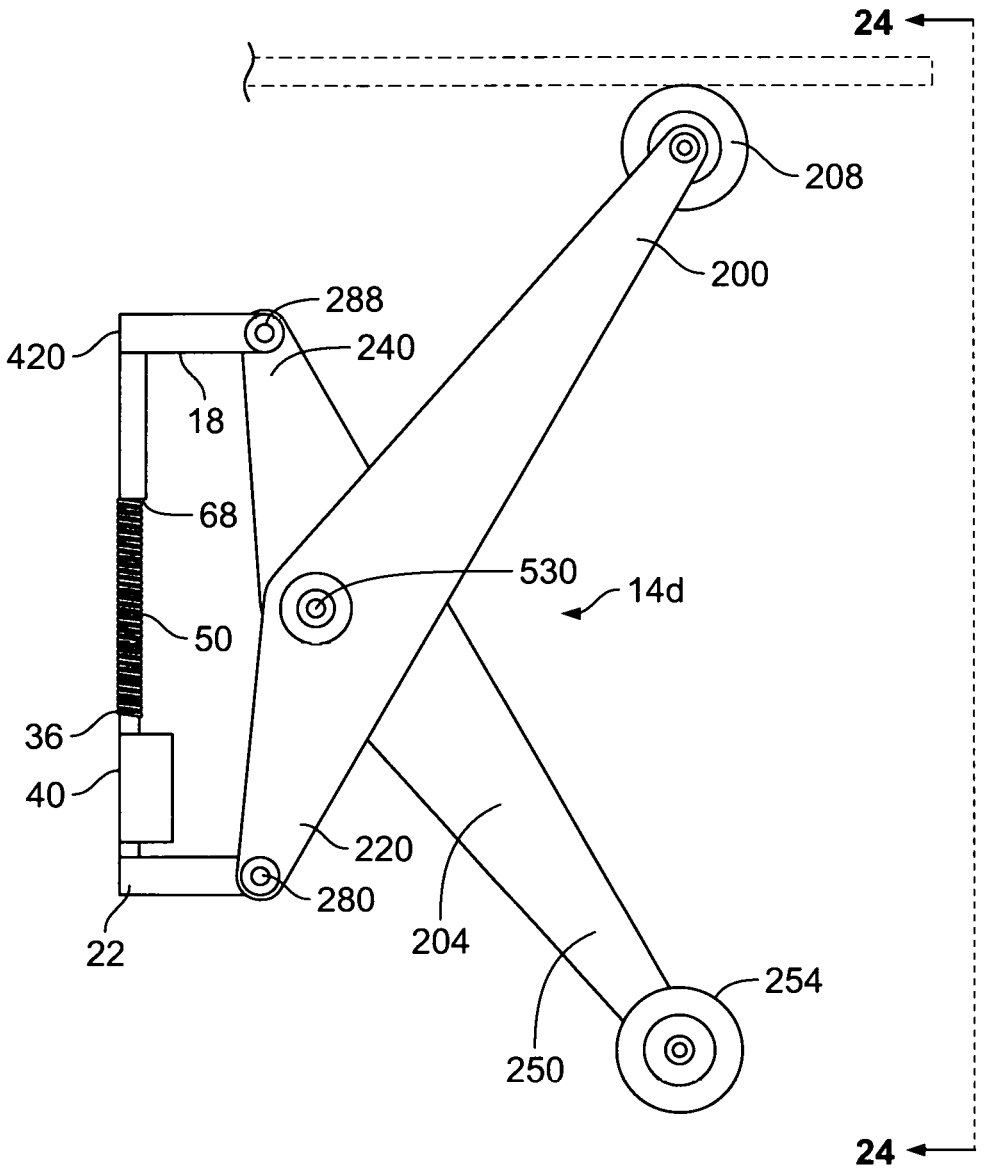
FIG. 23 is a side elevational view taken in direction of the arrows and along the plane of line 23-23 in FIG. 22.
Figure 26:
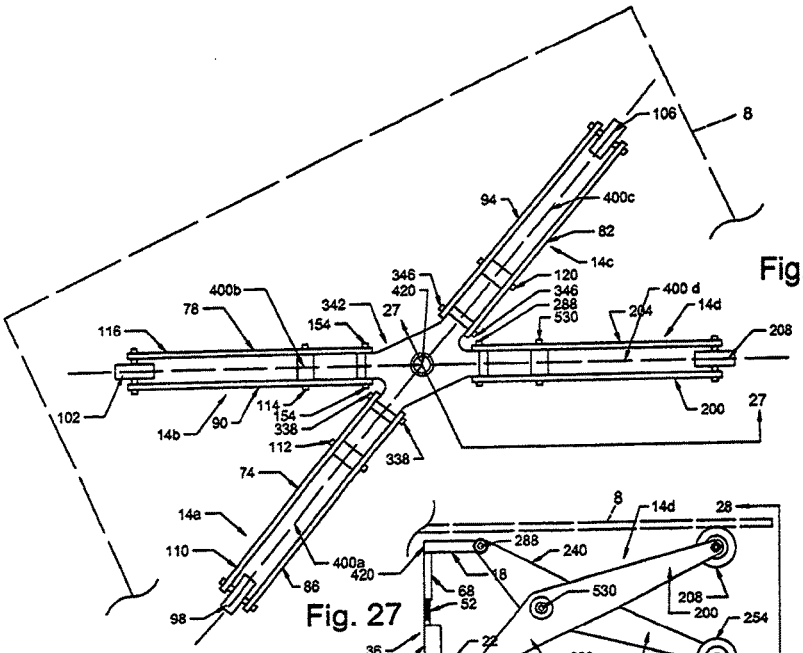
FIG. 26 is a top plan view of yet another embodiment of the invention wherein a radially-centered scissor lift assembly for a table is shown in the low position and where each of the scissor assemblies have a radial scissor axis which all cross at a point where the actuator axis of the actuator assembly, the lower vertical axis of the lower support member and the upper vertical axis of the upper support member are all aligned.
Figure 27:
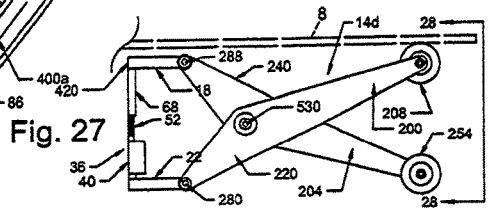
FIG. 27 is a side elevational view taken in direction of the arrows and along the plane of line 27-27 in FIG. 26.
Figure 28:
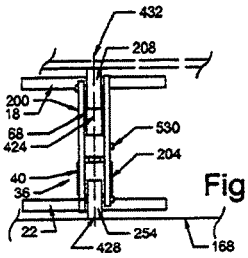
FIG. 28 is an end elevational view taken in direction of the arrows and along the plane of line 28-28 in FIG. 27.
Figure 29:
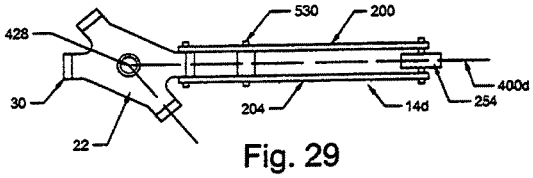
FIG. 29 is a bottom plan view of the lower support member and one of the scissor assemblies in FIG. 26 coupled thereto.
Figure 30:
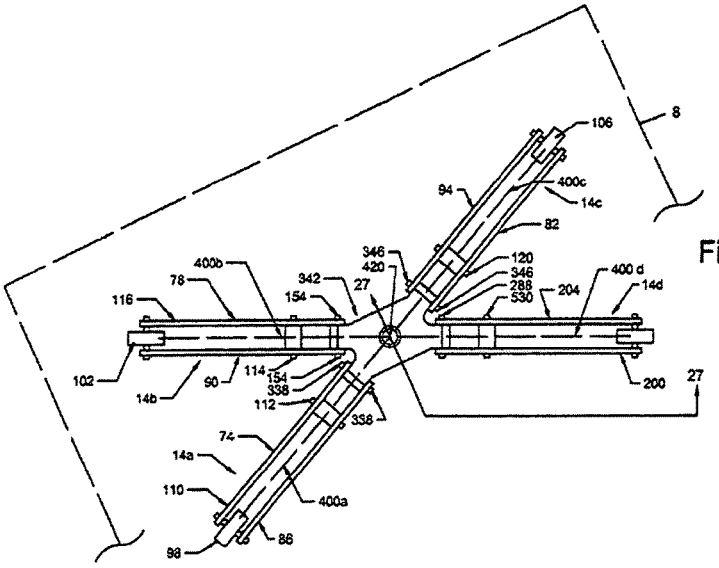
FIG. 30 is a top plan view of the embodiment of the invention in FIG. 26 wherein the radially-centered scissor lift assembly for a table is shown in the midway position and where each of the scissor assemblies have a radial scissor axis which all cross at a point where the actuator axis of the actuator assembly, the lower vertical axis of the lower support member and the upper vertical axis of the upper support member are all aligned.
Figure 32:
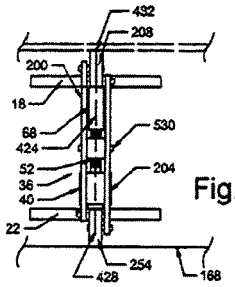
FIG. 32 is an end elevational view taken in direction of the arrows and along the plane of line 32-32 in FIG. 31.
Figure 33:
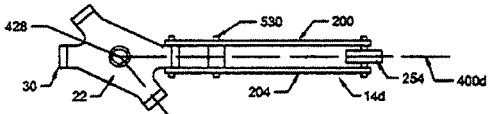
FIG. 33 is a bottom plan view of the lower support member and one of the scissor assemblies in FIG. 30 coupled thereto.
Figure 31:
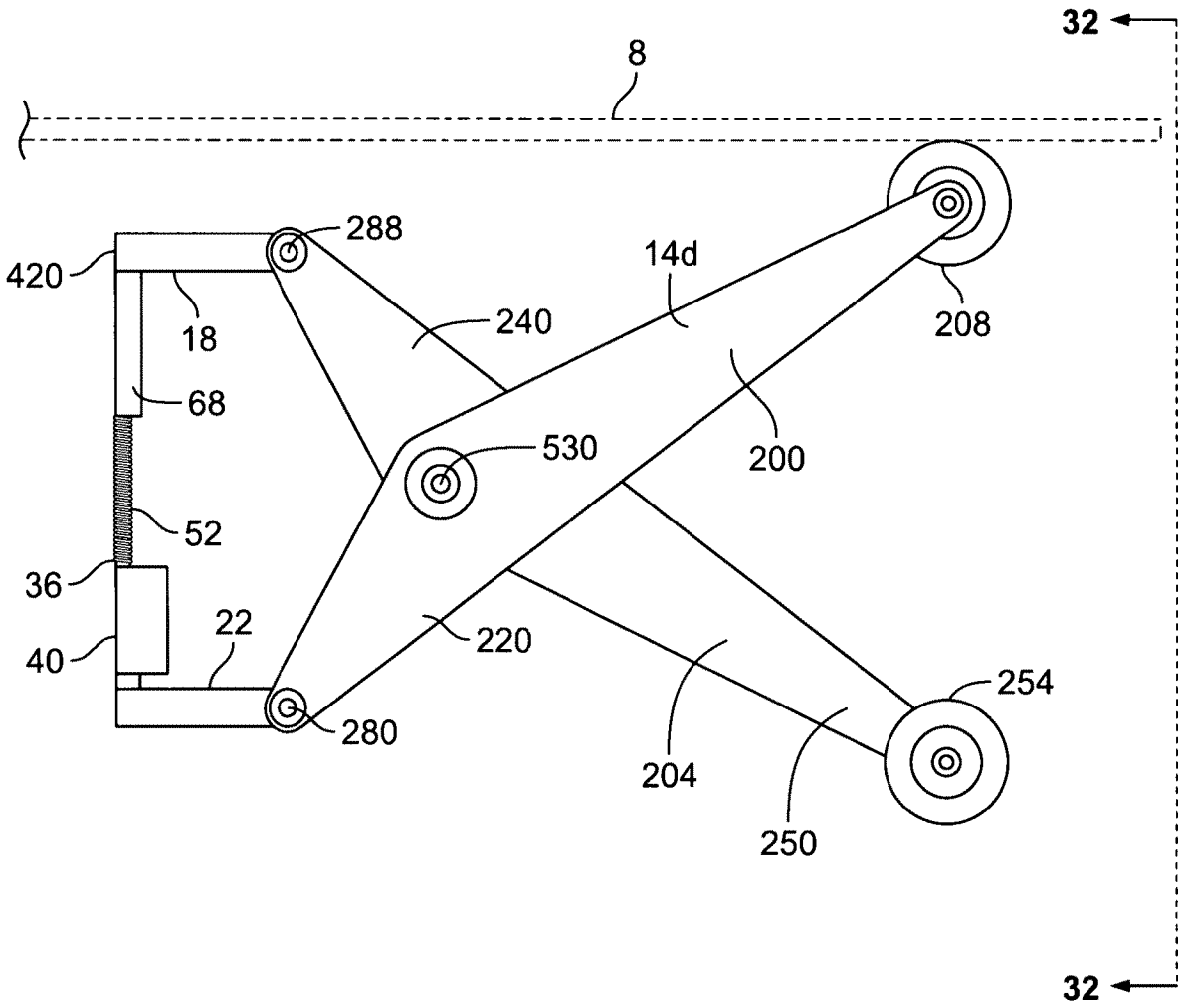
FIG. 31 is a side elevational view taken in direction of the arrows and along the plane of line 31-31 in FIG. 30.
Figure 34:
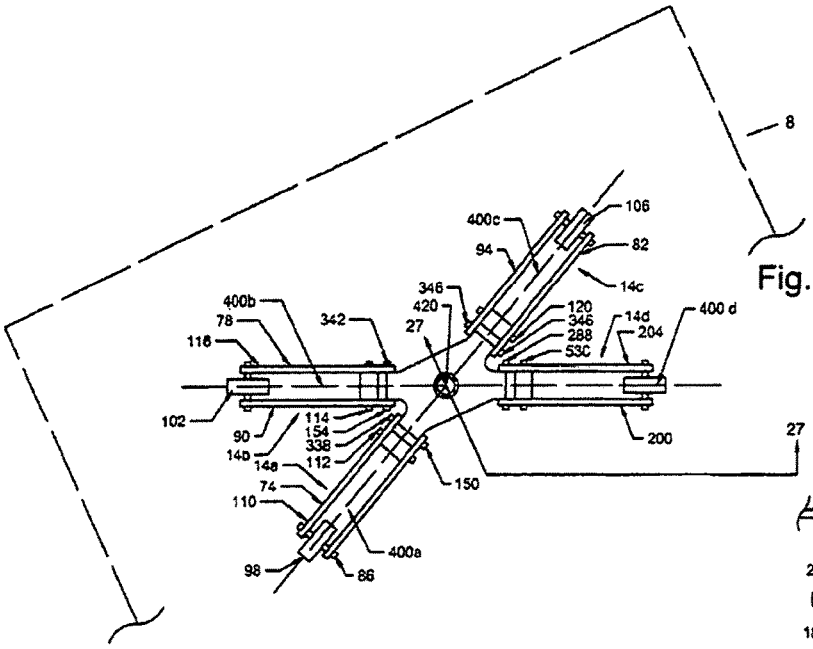
FIG. 34 is a top plan view of the embodiment of the invention in FIG. 26 wherein the radially-centered scissor lift assembly for a table is shown in the high or fully elevated position and where each of the scissor assemblies have a radial scissor axis which all cross at a point where the actuator axis of the actuator assembly, the lower vertical axis of the lower support member and the upper vertical axis of the upper support member are all aligned.

Continuing to refer to FIGS. 14-25, the space between scissor assemblies 14*c* and 14*d* is smaller than the space between scissor assemblies 14*b* and 14*c*. Similarly, the space between scissor assemblies 14*a* and 14*b* is smaller than the space between scissor assemblies 14*a* and 14*d*. The four scissor assemblies 14*a*, 14*b*, 14*c* and 14*d* respectively have radial scissor axis 400*a*, 400*b*, 400*c* and 400*d* which intercept at various points offset from point 420 (see FIGS. 14, 18 and 22) which is an alignment point (as best shown in FIG. 16) representing where an actuator axis 424 of the actuator assembly 36, a lower vertical axis 428 of the lower support member 22 and an upper vertical axis 432 of the upper support member 18 are all aligned. As shown in FIGS. 14, 18 and 22, radial scissor axis 400*a* intercepts radial scissor axis 400*d* and radial scissor axis 400*b* at respective points 504 and 508 which are all offset from point 420. Radial scissor axis 400*b* intercepts radial scissor axis 400*c* and radial scissor axis 400*a* at respective points 512 and 508 which are all offset from point 420. Radial scissor axis 400*c* intercepts radial scissor axis 400*b* and radial scissor axis 400*d* at respective points 512 and 516 which are all offset from point 420. Radial scissor axis 400*d* intercepts radial scissor axis 400*a* and radial scissor axis 400*c* at respective points 504 and 516 which are all offset from point 420. FIG. 15 shows pivot point 530 as being the point where table-scissor member 200 pivots against floor-scissor member 204 for moving table-scissor member 200 and floor-scissor member 204 relative to each other in a scissor-like fashion.

Referring now to FIGS. 26-37 there is seen another embodiment of the invention having four scissor assemblies 14*a*, 14*b*, 14*c* and 14*d* which are alternatively unequally spaced and centered radially for supporting a table top 8 having a non-circular configuration, such as a square or rectangular table top or an oval shaped table top. As shown in FIGS. 26-37, the lower and upper support members 22 and 18, and the lugs 30 and 26 respectively associated with the lower and upper support members 22 and 18, are all configured such that when they are coupled to the four scissor assemblies 14*a*, 14*b*, 14*c* and 14*d*, the four scissor assemblies 14*a*, 14*b*, 14*c* and 14*d* are alternatively unequally spaced and are centered radially (see FIG. 26).

Figure 36:
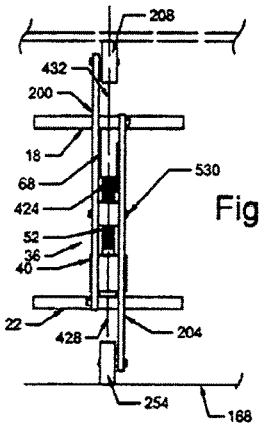
FIG. 36 is an end elevational view taken in direction of the arrows and along the plane of line 36-36 in FIG. 35.
Figure 37:
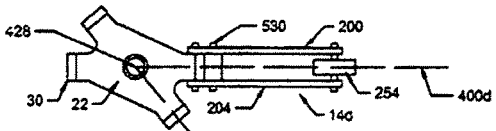
FIG. 37 is a bottom plan view of the lower support member and one of the scissor assemblies in FIG. 34 coupled thereto.
Figure 35:
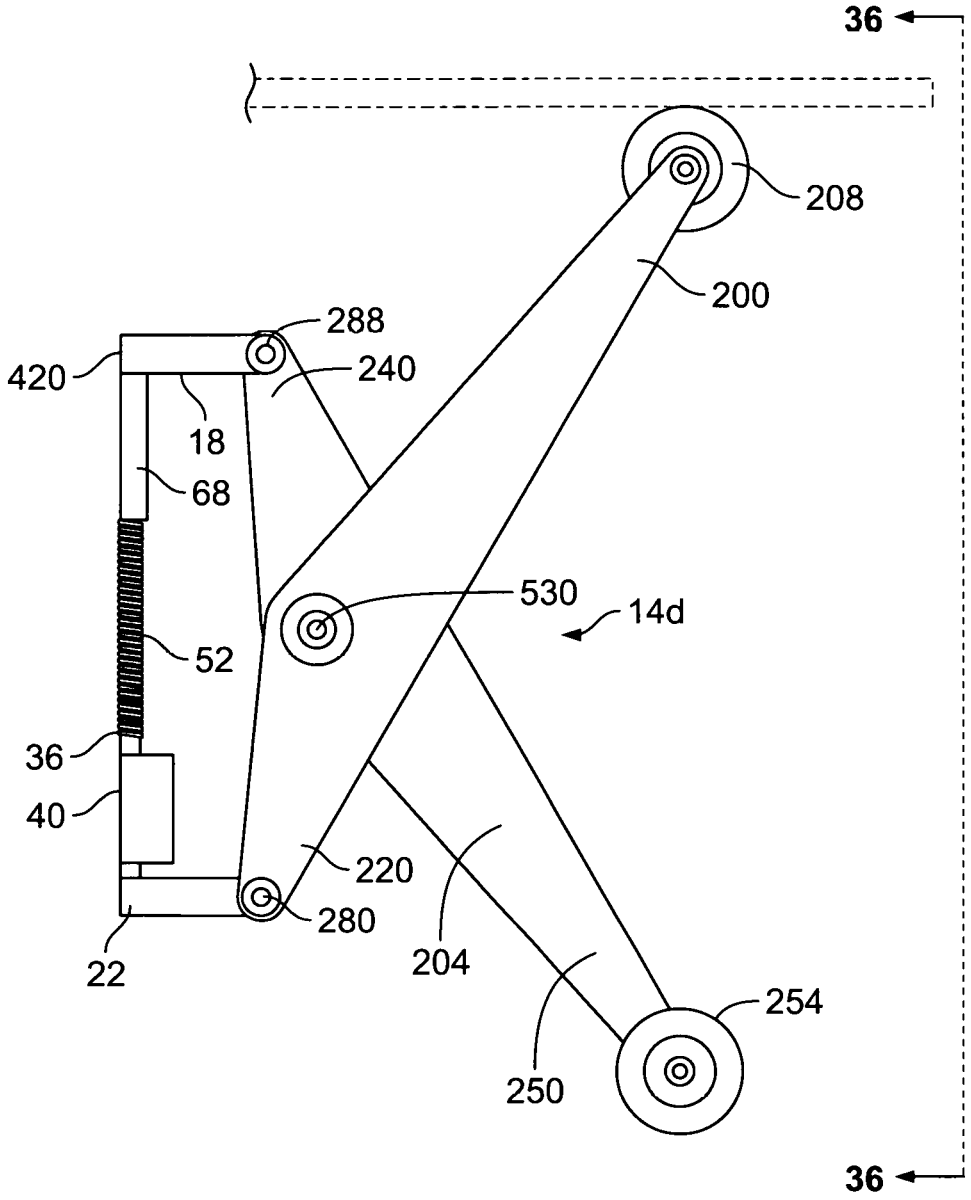
FIG. 35 is a side elevational view taken in direction of the arrows and along the plane of line 35-35 in FIG. 34.

Continuing to refer to FIGS. 26-37, the space between scissor assemblies 14*c* and 14*d* is smaller than the space between scissor assemblies 14*b* and 14*c*. Similarly, the space between scissor assemblies 14*a* and 14*b* is smaller than the space between scissor assemblies 14*a* and 14*d*. The four scissor assemblies 14*a*, 14*b*, 14*c* and 14*d* respectively have radial scissor axis 400*a*, 400*b*, 400*c* and 400*d* which intercept at point 420 (see FIGS. 26, 30 and 34) which is an alignment centered point (as best shown in FIG. 36) representing where an actuator axis 424 of the actuator assembly 36, a lower vertical axis 428 of the lower support member 22 and an upper vertical axis 432 of the upper support member 18 are all aligned.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

Additionally, any directional arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims.

What is claimed is:

1. A radial-scissor lift assembly for a table top comprising:
an upper support member;
a lower support member;
a table top having a bottom;
at least three scissor assemblies coupled to the upper and lower support members;
an actuator assembly coupled to the lower support member and to the upper support member for moving the scissor assemblies;
each scissor assembly including a table-scissor member rotatably supporting a table wheel, each said table wheel contacts the bottom of the table top for supporting the table top and for radially moving on the bottom of the table top towards or away from the upper support member; and
each scissor assembly further including a floor-scissor member rotatably supporting a floor wheel, each said floor wheel contacts a surface supporting the radial-scissor lift assembly and is adapted for radially moving on the surface towards or away from the lower support member.

2. The radial-scissor lift assembly of claim 1 wherein said table top is disposed on said table wheels and remain continually spaced from the upper support member when the actuator assembly moves the table wheels and floor wheels relative to each other.

3. The radial-scissor lift assembly of claim 1 wherein the upper support member and the lower support member are vertically aligned; said upper support member comprises a structure defining at least three upper protruding lugs, and the lower support member comprises a structure defining at least three lower protruding lugs, and said three scissor assemblies are pivotally coupled to the upper lugs and to the lower lugs.

4. The radial-scissor lift assembly of claim 3 wherein said table scissor members are pivotally connected the lower protruding lugs, and said floor scissor members are pivotally connected to the upper protruding lugs.

5. The radial-scissor lift assembly of claim 1 wherein said three scissor assemblies comprises a first scissor assembly, a second scissor assembly and a third assembly, and the angle between the first and second assemblies, and the angle between the second and third assemblies, and the angle between the third and first table assemblies are essentially equal.

6. The radial-scissor lift assembly of claim 1 herein the table scissor member is pivotally connected to the floor-scissor member.

7. The radial-scissor lift assembly of claim 1 wherein said actuator assembly moves the lower support member away from or toward the upper support member.

8. The radial-scissor lift assembly of claim 7 additionally comprising a conduit member affixed to the upper support member and includes an internal cylindrical surface.

9. The radial-scissor lift assembly of claim 8 wherein said actuator assembly comprises a shaft that engages the internal cylindrical surface of the conduit member and is adapted for moving linearly therein, and movement of the upper and lower support members towards each other is caused by clockwise rotation of the shaft.

10. The radial-scissor lift assembly of claim 1 additionally comprising a conduit member affixed to the upper support member and includes an internal cylindrical surface.

11. The radial-scissor lift assembly of claim 10 wherein said actuator assembly comprises a shaft that engages the internal cylindrical surface of the conduit member and is adapted for moving linearly therein.

12. The radial-scissor lift assembly of claim 1 wherein each table wheel includes a table-wheel hub, each floor wheel includes a floor-wheel hub, and said table-wheel hubs and floor-wheel hubs are vertically aligned and remain vertically aligned as said table wheels and floor wheels radially move.

13. An offset radial-scissor lift assembly for a table top comprising:

an upper support member having an upper vertical axis;

a lower support member having a lower vertical axis;

a table top having a bottom;

a plurality of scissor assemblies coupled to the upper and lower support members;

an actuator assembly having an actuator axis aligned with the lower vertical axis and the upper vertical axis and coupled to the lower support member and to the upper support member for moving the scissor assemblies;

each of at least two contiguous scissor assemblies of said scissor assemblies having a radial scissor axis which are offset from the actuator axis of the actuator assembly;

each scissor assembly including a table-scissor member rotatably supporting a table wheel, each said table wheel contacts the bottom of the table top for supporting the table top and for moving on the bottom of the table top towards or away from the upper support member; and each scissor assembly further including a floor-scissor member rotatably supporting a floor wheel, each said floor wheel contacts a surface supporting the offset radial-scissor lift assembly and is adapted for moving on the surface towards or away from the lower support member.

14. The offset radial-scissor lift assembly of claim 13 additionally comprising a conduit member affixed to the upper support member and includes an internal cylindrical surface.

15. The offset radial-scissor lift assembly of claim 14 wherein said actuator assembly comprises a shaft that engages the internal cylindrical surface of the conduit member and is adapted for moving linearly therein, and movement of the upper and lower support members towards each other is caused by clockwise rotation of the shaft.

16. The offset radial-scissor lift assembly of claim 14 wherein said actuator assembly comprises a shaft that engages the internal cylindrical surface of the conduit member and is adapted for moving linearly therein.

17. A radially-centered scissor lift assembly for a table top comprising:

an upper support member having an upper vertical axis;

a lower support member having a lower vertical axis;

a table top having a bottom;

a plurality of scissor assemblies coupled to the upper and lower support members; said plurality of scissor assemblies comprising, at least one first pair of contiguous scissor assemblies and at least one second pair of contiguous scissor assemblies; said first pair of contiguous scissor assemblies is angularly spaced at a different angle from an angular space separating said second pair of contiguous scissor assemblies;

an actuator assembly having an actuator axis aligned with the lower vertical axis and the upper vertical axis and coupled to the lower support member and to the upper support member for moving the scissor assemblies;

each scissor assembly including a table-scissor member rotatably supporting a table wheel, each said table wheel contacts the bottom of the table top for supporting the table top and for moving on the bottom of the table top towards or away from the upper support member; and each scissor assembly further including a floor-scissor member rotatably supporting a floor wheel, each said floor wheel contacts a surface supporting the scissor lift assembly and is adapted for moving on the surface towards or away from the lower support member.

18. The radially-centered scissor lift assembly of claim 17 additionally comprising a conduit member affixed to the upper support member and includes an internal cylindrical surface.

19. The radially-centered scissor lift assembly of claim 18 wherein said actuator assembly comprises a shaft that engages the internal cylindrical surface of the conduit member and is adapted for moving linearly therein, and movement of the upper and lower support members towards each other is caused by clockwise rotation of the shaft.

20. The radially-centered scissor lift assembly of claim 18 wherein said actuator assembly comprises a shaft that engages the internal cylindrical surface of the conduit member and is adapted for moving linearly therein.

* * * * *